United States Patent [19]

Swisher, Jr.

[11] Patent Number: 4,928,890

[45] Date of Patent: May 29, 1990

[54] APPARATUS AND METHOD FOR PRODUCING COLD MIX ASPHALT

[75] Inventor: George W. Swisher, Jr., Oklahoma City, Okla.

[73] Assignee: CMI Corporation, Oklahoma City, Okla.

[21] Appl. No.: 691,498

[22] Filed: Jan. 14, 1985

[51] Int. Cl.[5] ..... B02C 21/02

[52] U.S. Cl. ..... 241/24; 241/34; 241/81; 241/101.7

[58] Field of Search ..... 404/90, 91, 92, 84; 241/81, 24, 29, 101.7, 101 D, 101.1, 22, 15, 16, 21, 34

[56] References Cited

U.S. PATENT DOCUMENTS

| | | | |
|---|---|---|---|
| 1,938,755 | 12/1933 | Swearingen . | |
| 2,181,320 | 11/1939 | Flynn . | |
| 2,394,017 | 2/1946 | Seaman . | |
| 2,424,459 | 7/1947 | Hettelsater . | |
| 2,885,934 | 5/1959 | Gardner . | |
| 2,917,395 | 12/1959 | Csanyi . | |
| 3,224,347 | 12/1935 | Seaman . | |
| 3,361,042 | 1/1968 | Cutler . | |
| 3,598,027 | 8/1971 | Swisher, Jr. . | |
| 3,843,274 | 10/1974 | Gutman . | |
| 4,453,856 | 6/1984 | Chiostri et al. | 404/91 |

OTHER PUBLICATIONS

"Foamed Asphalt", by L. H. Csanyi, technical bulletin No. 240, American Roadbuilders Association, 1959.

"Use of Foamed Asphalt in Soil Stabilization", by R. M. Nady and L. H. Casnyi, pp. 452–467.

"In-place Recycling on Track for Future", pp. 62–64, May, 1984 issue of Highway and Heavy Construction.

*Primary Examiner*—Mark Rosenbaum

*Attorney, Agent, or Firm*—Dunlap, Codding, Peterson & Lee

[57] ABSTRACT

An apparatus to be towed behind a roadway planing machine to mix aggregate planed from a roadway into cold mix asphalt for repaving the roadway. The aggregate is introduced, via an inclined shaker screen, into a surge bin and conveyed from the surge bin to a pugmill on the chassis of the apparatus by a belt conveyor underlying the surge bin. The conveyor is driven through an electrically adjustable first variable transmission and manual and automatic controls are provided to adjust the speed ratio of the first transmission to maintain the level of aggregate in the surge bin between selected high and low levels. A pump is driven by the first variable transmission through a second variable transmission to select and fix the ratio of aggregate to asphaltic composition in the pugmill for varying rates of conveyor operation corresponding to different speed ratios of the first transmission. A crusher is provided to comminute large pieces of aggregate that gravitate off the lower end of the shaker screen and the comminuted aggregate is returned to the shaker screen via a belt conveyor that discharges onto a conveyor of the roadway planing machine that discharges onto the screen.

34 Claims, 7 Drawing Sheets

APPARATUS AND METHOD FOR PRODUCING COLD MIX ASPHALT

BACKGROUND OF THE INVENTION

1. Field of the Invention

The present invention relates generally to improvements in the production of cold mix asphalt and, more particularly, but not by way of limitation, to the production of cold mix asphalt from material planed from a roadway in an apparatus towed by the roadway planer during roadway planing operations.

2. Brief Description of the Prior Art

It has long been recognized that considerable savings can be achieved in the refurbishing of a roadway by using the roadway itself as a source of paving material. Thus, a number of machines have been constructed to disintegrate an upper layer of a roadway within a hood while asphaltic composition, that is, a heavy oil, is injected into the hood so that cold mix asphalt is mixed within the hood while the disintegration of the layer of the roadway occurs. The cold mix asphalt can then be compacted to form a new driving surface for the roadway.

While the repaving of a roadway in this manner is useful in a number of circumstances, other circumstances exist in which the resulting refurbished roadway will not be adequate to the demands that will be placed on the roadway. In particular, because of the lack of control of the aggregate-to-asphaltic composition ratio of the resulting cold mix asphalt, the quality of the cold mix asphalt may not meet required standards. In these circumstances, it is necessary either to produce the asphalt elsewhere and deliver it to the roadway or to provide expensive mechanisms on a traveling cold mix plant to precisely fix the ratio of aggregate to asphaltic composition that is produced in the plant. For example, it is known to weigh material that is cut from a roadway as the material is introduced into a pugmill and then meter asphaltic composition into the pugmill in accordance with the weight of material that has been introduced into the pugmill. While this approach is workable, it suffers from several disadvantages. Initially, the weighing of the material cut from a roadway; that is, the aggregate from which the new cold mix asphalt is formed, requires expensive equipment and such equipment can be sensitive to vibration as the cold mix asphalt plant is drawn along the roadway so that the ratio of aggregate to asphaltic composition can undergo a considerable variation as the cold mix asphalt is produced.

SUMMARY OF THE INVENTION

The present invention provides an apparatus and method for producing cold mix asphalt that overcomes these problems. In particular, the cold mix asphalt is produced in an apparatus that can be drawn behind a roadway planing machine to produce asphalt from cuttings planed from the roadway and precisely control the ratio of aggregate to asphaltic composition without incurring the expense of weighing the aggregate before the introduction of the aggregate into a pugmill nor incurring the expense or the complexity of a control system necessary in prior art apparatus to maintain a fixed aggregate-to-asphaltic composition ratio when the aggregate is weighed prior to introduction into a pugmill. To these ends, the present invention contemplates the introduction of material planed from a roadway into a surge bin and the maintenance of the level of aggregate in the surge bin at a level that will permit the aggregate to be volumetrically metered from the surge bin into a pugmill without regard to the rate at which aggregate may be planed from a roadway and introduced into the surge bin. It has been found that the volume of aggregate delivered from the surge bin to the pugmill provides a good measure of the weight of aggregate delivered to the pugmill providing the level of aggregate in the surge bin can be maintained within a range between two pre-selected levels in the surge bin and the present invention contemplates the maintenance of the aggregate level within such range to eliminate the need for weighing the aggregate as the aggregate is introduced into a pugmill. Maintenance of the level of the aggregate in the surge bin is carried out by varying the speed at which the conveyor that delivers the aggregate from the surge bin to the pugmill is driven so that, while the weight and volume of material delivered to the pugmill changes in accordance with the level of aggregate in the surge bin, the ratio of weight to volume remains constant. A pump that delivers asphaltic composition to the pugmill is then mechanically coupled to the conveyor so that the rate at which the pump operates to deliver asphaltic composition to the pugmill follows the rate at which the conveyor delivers aggregate to the pugmill. Accordingly, even though these rates may vary, the ratio of aggregate to asphaltic composition delivered to the pugmill remains constant to provide a high quality cold mix asphalt that is deposited on a roadway being resurfaced for subsequent spreading and compacting operations.

In order to maintain the level of the aggregate in the surge bin between the pre-selected levels, the conveyor that delivers the aggregate from the surge bin to the pugmill is driven through a variable transmission that ca either be manually or automatically controlled to increase or decrease the rate at which the conveyor is operated and the pump is driven by a second variable transmission that is coupled to the variable transmission that drives the conveyor. The speed ratios of input and output shafts to the variable transmissions can be electrically controlled so that the rate at which the conveyor is driven can be changed by means of electrical signals supplied to the variable transmission through which the conveyor is driven and the ratio of aggregate to asphaltic composition delivered to the pugmill can be selected, and maintained, via electrical signals transmitted to the variable transmission that drives the pump, to initially set the ratio of speeds of the input and output shafts of the pump drive variable transmission. The mechanical coupling between the two transmissions then insures that the ratio of aggregate to asphaltic composition in the pugmill will always remain the same regardless of the rate at which the conveyor is driven to maintain a fixed weight-to-volume ratio for the aggregate transported from the surge bin to the pugmill by the conveyor.

An important object of the present invention is to provide an apparatus for producing cold mix asphalt that will closely control the ratio of aggregate to asphaltic composition in the cold mix asphalt the apparatus produces.

Another object of the invention is to provide an apparatus for producing cold mix asphalt that can be drawn behind a roadway planing machine to produce the asphalt from cuttings planed from the surface of a roadway and deposit the cold mix asphalt on the roadway during roadway planing operations.

Another object of the invention is to provide a method and apparatus for producing cold mix asphalt which eliminates any need for weighing the aggregate to obtain a fixed ratio of aggregate to asphaltic composition in the cold mix asphalt that is produced.

Other objects, advantages and features of the present invention will become clear from the following detailed description of the invention when read in conjunction with the drawings and appended claims.

BRIEF DESCRIPTION OF THE DRAWINGS

FIG. 6 is a side elevational view of the coupling assembly used to connect the cold mix asphalt apparatus of the present invention to the rear end of a roadway planing machine so that the cold mix asphalt apparatus can be towed behind the roadway planing machine during roadway planing operations to concurrently convert cuttings from the roadway to new cold mix asphalt.

DESCRIPTION OF THE PREFERRED EMBODIMENT

Figure 1:
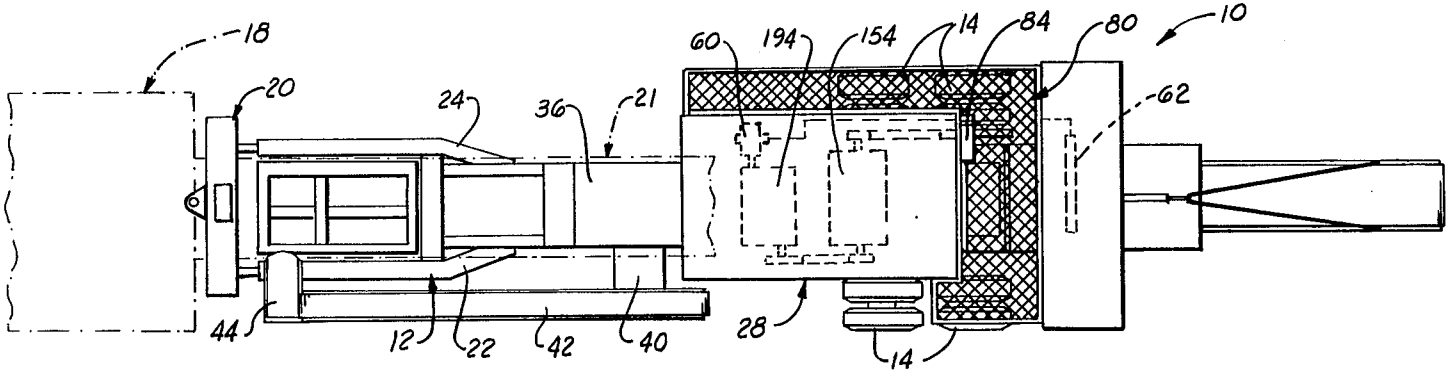
FIG. 1 is a plan view of an apparatus for producing cold mix asphalt that is constructed in accordance with the present invention.
Figure 2:
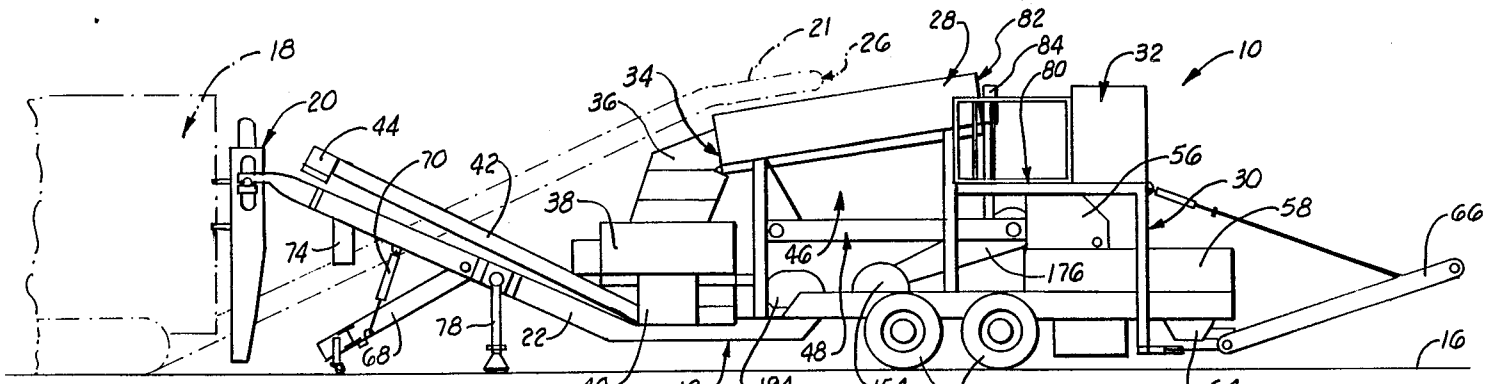
FIG. 2 is a side elevational view of the apparatus shown in FIG. 1.

Referring now to the drawings in general and to FIGS. 1 and 2 in particular, shown therein and designated by the general reference numeral 10 is an apparatus constructed in accordance with the present invention to produce cold mix asphalt. The apparatus 10 is comprised of a chassis 12 that is mounted on wheels 14 so that the apparatus 10 can be towed along a roadway 16 behind a roadway planing machine 18 that has been indicated in phantom lines in FIGS. 1 and 2. To adapt the apparatus 10 for towing, such apparatus further comprises a coupling assembly 20 that can be mounted on the rear end of the roadway planing machine and to which the chassis 12 is connected as will be discussed below. The invention contemplates that the roadway planing machine will be comprised of a discharge conveyor 21 that extends rearwardly and upwardly from the body of the machine so that material planed from the roadway 16 can be delivered above central portions of the apparatus 10. A roadway planing machine having these characteristics is disclosed in U.S. Pat. No. 4,325,580 issued Apr. 20, 1982 to Swisher, Jr. et al.

As shown in FIGS. 1 and 2, the chassis 12 is comprised of two generally parallel base beams, 22 and 24, that extend substantially the length of the chassis 12 and the discharge conveyor 21 of the roadway planing machine 18 extends upwardly between the base beams 22, 24 when the apparatus 10 is attached to the rear end of the roadway planing machine 18 so that the discharge conveyor 21 terminates in a distal end 26 that is positioned above central portions of the apparatus 10. An inclined, conventional shaker screen 28 is supported on the chassis 12 via a supporting frame 30 that is attached to the chassis 12 and extends upwardly therefrom to further support a motor generator 32 that provides electrical power for the operation of the apparatus 10. During concurrent roadway planing and cold mix asphalt production operations, the discharge conveyor 21 of the roadway planing machine 18 is positioned above the shaker screen 28 and the shaker screen is electrically operated, via power provided by the motor generator 32, in a conventional manner so that the material planed from the roadway 16 and discharged onto the shaker screen 28 will be sorted according to size. In particular, the shaker screen 28 divides the material planed from the roadway 16 into a first portion having a particle size smaller than a pre-selected maximum particle size that is built into the shaker screen 28 and a second portion that is comprised of large pieces of material planed from the roadway 16. The first portion of this material passes through the shaker screen 28 to become aggregate that is used in the production of cold mix asphalt by the apparatus 10 and the second portion of the material gravitates to the lower end 34 of the shaker screen 28 to be transferred via a chute 36 into a conventional crusher 38 that is electrically operated from power supplied by the motor generator 32 to comminute the larger pieces of material that have been discharged onto the screen 28. Following comminution of these pieces in the crusher 38, the pieces are discharged from the crusher via a chute 40 onto a conventional belt conveyor 42 that is electrically operated from power supplied by the motor generator 32 to transport the comminuted material forwardly and upwardly to a chute 44 that deposits the crushed material onto the discharge conveyor 21 of the roadway planing machine 18. Thus, all of the material planed from the roadway 16 is eventually converted into aggregate having a pre-selected maximum size that passes through the shaker screen 28.

Figure 3:
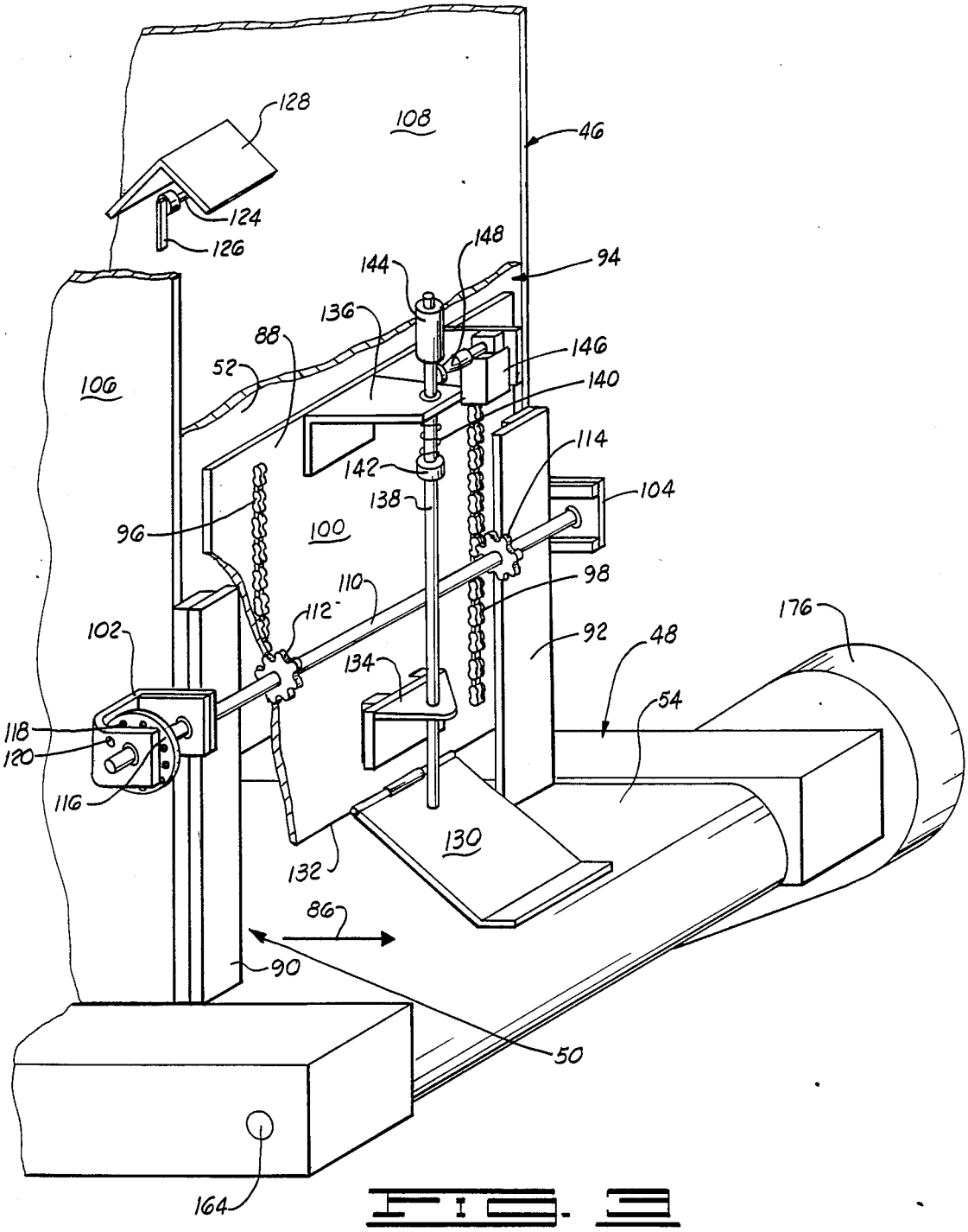
FIG. 3 is an isometric view of rear portions of the surge bin of the apparatus shown in FIGS. 1 and 2 illustrating portions of a control circuit for automatically maintaining the level of aggregate in the surge bin between pre-selected upper and lower limits.

A surge bin 46 is disposed below the shaker screen 28 to receive the aggregate passing through the screen 28, the surge bin 46 having an open lower end as shown in FIG. 3, and a belt conveyor 48 is mounted on the supporting frame 30 to support the surge bin 56 below the screen 28. As shown in FIG. 3, the surge bin 46 has an opening 50 formed in a rear end wall 52 thereof that overlays the belt 54 of the conveyor 48 so that the conveyor 48 can transport aggregate in the surge bin 46 through the opening 50 to discharge the aggregate from the bin 46 into a chute 56 (FIG. 2) discharging into a conventional pugmill 58 mounted on rear portions of the chassis 12. The apparatus 10 is comprised of a pump 60 mounted on the chassis 12 as shown in FIG. 1 and the pump 60 is connected via conventional piping to a spray bar 62 mounted on the chute 56 to spray asphaltic composition into the pugmill 58. During operation of the apparatus 10, the pugmill 58 is electrically operated to mix aggregate and asphaltic composition introduced into the pugmill 58 into cold mix asphalt and to discharge the asphalt via a chute 64 onto a conventional, electrically operated belt conveyor 66 by means of which the asphalt produced in the pugmill 58 is deposited on the roadway 16.

Near the forward end of the apparatus 10, the base beams 22 and 24 are inclined upwardly as shown for the forward portion of the base beam 22 in FIG. 2 to connect to the coupling assembly 20 when such assembly is mounted on the rear end of a roadway planing machine 18. The chassis 12 further comprises a towing frame 68 that is pivotally mounted between the upwardly extending portions of the base beams 22, 24 and can be moved between upper and lower positions on the base beams 22, 24 via hydraulic actuating cylinders, one of which has been illustrated in FIGS. 2 and 6 and designated by the numeral 70 therein, the hydraulic actuating cylinders being connected between the base beams 22, 24 and the towing frame 68. In FIGS. 2 and 6, the towing frame 68 is shown in the lower position thereof in which the towing frame 68 will be disposed when the apparatus 10 is towed behind a roadway planing machine, by the coupling assembly 20, to produce cold mix asphalt from material planed from a roadway 16 by the roadway planing machine 18. In such lowered position, the towing frame 68 supports a sensor that determines the height of forward portions of the chassis 12 above the roadway 16 so that the chassis 12 can be maintained in a level position as the apparatus 10 is drawn along the roadway 16 in a manner to be discussed below. In the upper position of the towing frame 68, the towing frame 68 extends substantially horizontally and I-beams, such as the I-beam illustrated in FIG. 6 and designated by the numeral 72 therein, that extend laterally from the sides of the towing frame 68 are bolted to depending posts, such as the post 74 illustrated in FIGS. 2 and 6, that depend from the base beams 22 and 24. In the upper position, the apparatus 10 can be towed via a conventional towing connector 76 (FIG. 6) mounted on the underside of the towing frame 68. Jacks, one of which has been illustrated in FIG. 2 and designated by the numeral 78 therein, are mounted on the base beams 22 and 24 to support the apparatus 10 when the apparatus 10 is parked. A catwalk 80 is positioned between the upper, or rear, end 82 of the shaker screen 28 and the motor generator 32, the catwalk 80 being supported by the supporting frame 30 to extend about rear portions of the shaker screen 28. During use of the apparatus 10, the operator of the apparatus stands on the catwalk 80 and suitable ladders (not shown) are mounted on the supporting frame 30 to provide easy access to the catwalk 80. An operator's console 84 is mounted on the supporting frame 30 at the rear end 82 of the shaker screen 28 so that an operator on the catwalk 80 can control the operation of the apparatus 10 in a manner to be discussed below.

Turning now to FIG. 3, shown therein are rear portions of the surge bin 46 and the conveyor 48 by means of which aggregate is discharged from the surge bin 46. As can be seen in FIG. 3, and as has been noted above, the surge bin 46 has an open lower end so that the belt 54 of the conveyor 48 forms a floor for the surge bin 46 and aggregate dropped into the surge bin 46 will rest on the belt 54 of the conveyor 48. As has also been previously noted, the rear wall 52 of the surge bin 46, that faces the chute 56 into the pugmill 58, is provided with the previously identified opening 50 so that operation of the conveyor 48 to drive the belt 54 in the direction 86 shown in FIG. 3 will cause the belt 54 to carry aggregate in the surge bin 46 through the opening 50 for introduction of the aggregate into the pugmill 58. As will be clear to those skilled in the art, the volume per unit time of aggregate removed from the surge bin 46 by the conveyor 48 will depend upon the rate at which the belt 54 moves and the size of the opening 50 through which the aggregate is transported. As will be discussed below, the conveyor 48 ca be automatically controlled to operate at a normal speed, a maximum speed and a minimum speed to maintain the level of aggregate in the surge bin 46 between pre-selected levels and the rate at which aggregate is discharged from the surge bin 46 at these three rates of operation is made adjustable by slidably mounting a gate 88 on the wall 52 to partially occlude the opening 50 through the wall 52 of the surge bin 46. To this end, guides 90, 92 are welded to the rear end 94 of the surge bin 46, to either side of the opening 50, to support the gate 88 for vertical sliding movement along the wall 52 of the surge bin 46 so that the gate 88 ca be used to partially occlude the opening 50. The gate 88 is a rectangular metal sheet which slides in the guides 90, 92 and has racks 96 and 98, made of lengths of drive chain, welded to the outer surface 100 thereof. Brackets 102, 104 are mounted on side walls, 106 and 108 respectively, of the surge bin 46 to rotatably support a shaft 110 that extends horizontally across the rear end 94 of the surge bin 46 parallel to the surface 100 upon which the racks 96 and 98 are disposed. Sprockets 112 and 114 are mounted on the shaft 110 to engage the racks 96 and 98 so that the gate 88 can be raised and lowered by turning a hand wheel (not shown) on one end of the shaft 110. The bracket 102 is U-shaped and a locking wheel 116 is mounted on the shaft 110 between the legs of the bracket 102, the locking wheel 116 having a plurality of apertures 118 formed therethrough so that the position of the gate 88 on the rear end 94 of the surge bin 46 can be fixed by passing a bolt through a selected one of the apertures 118 and a hole 120 formed through the outer leg of the bracket 102.

Also shown in FIG. 3 are portions of a control circuit that is used to maintain the level of aggregate in the surge bin 46 between the aforementioned pre-selected levels. Preferably, the upper of these two levels is fixed and is established by mounting a switch 122 (not shown in FIG. 3 but indicated schematically in FIG. 5B) on the side wall 108 of the surge bin 46, the switch 122 being a rotary switch that can be actuated via the turning of a shaft 124 that extends through the side wall 108 into the interior of the surge bin 46. A paddle 126 is mounted on the end of the shaft 124 so that movement of aggregate within the surge bin 46 occasioned by the conveyor 48 will turn the paddle 126 to close the switch 122 when the aggregate has reached the level of the paddle 126 in the surge bin 46. The switch 122 is mounted on the exterior surface of the side wall 108 and portions of the switch 122 that extend into the surge bin 46 are protected by a shield 128 welded to the side wall 108 above the shaft 124 and the paddle 126.

The lower of the two levels of aggregate in the surge bin 46 is made adjustable and is adjusted via the positioning of the gate 88 on the end wall 52 of the surge bin 46. In particular, an aggregate engagement plate 130 is hingedly connected to the lower edge 132 of the gate 88 to extend from the gate 88 in the direction 86 in which aggregate is discharged from the surge bin 46. Brackets 134 and 136 are mounted on the surface 100 of the gate 88 to slidably support a rod 138 for vertical movement along the gate 88, the lower end of the rod 138 resting on the aggregate engagement plate 130. A spring 140 disposed between the bracket 136 and a collar 142 that can be positioned on the rod 138 and secured in position by a set screw (not shown) urges the lower end of the rod 138 into engagement with the aggregate engagement plate 130 and a second collar 144 is slidably mounted on portions of the rod 138 above the bracket 136, the collar 144 being fixable on the rod 138 by a set screw (not shown). A switch 146 is mounted on the bracket 136 and positioned thereon so that an operating handle 148 of the switch 146 can be engaged by the collar 144 when the rod 138 is shifted downwardly on the brackets 134 and 136 to close the switch 146. For automatic maintenance of the levels of aggregate in the surge bin 46, the collar 144 is positioned on the rod such that the switch 146 will be closed when the aggregate engagement plate 130 pivots downwardly from the gate 88 to a position below a position that is substantially parallel to the upper surface of the belt 54 of the conveyor 48.

Figure 4:
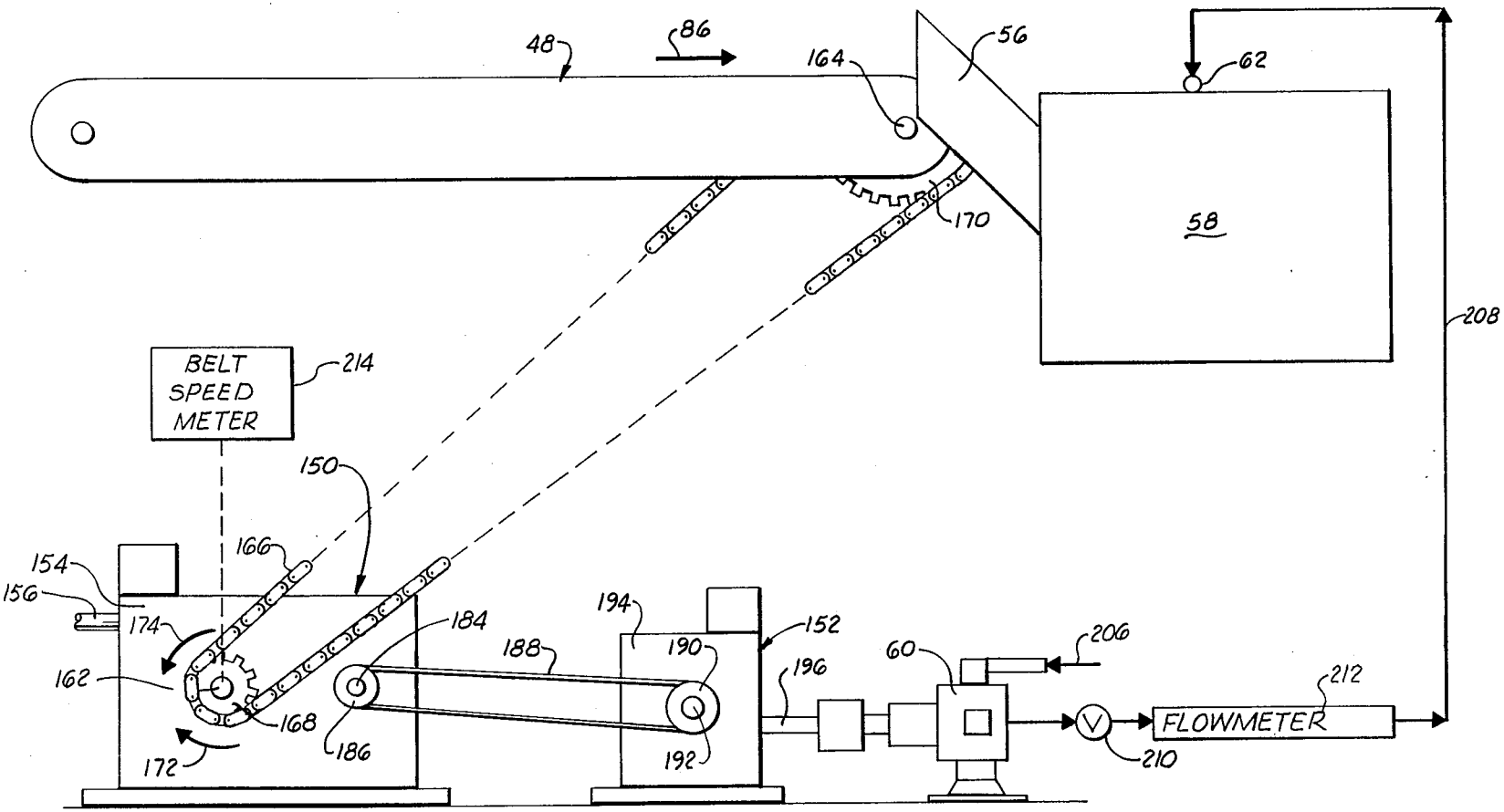
FIG. 4 is a schematic representation of the conveyor and pump drive assembly for maintaining a constant ratio of agqregate-to-asphaltic composition in the pugmill of the apparatus shown in FIGS. 1 and 2.

Turning now to FIG. 4, shown therein and designated by the general reference numeral 150 is a schematic diagram of portions of a conveyor drive assembly that is used to drive the conveyor 48 to deliver aggregate into the chute 56 (schematically represented in FIG. 4) to the pugmill 58 (also schematically represented in FIG. 4) and also shown in FIG. 4 is a schematic diagram of a pump drive assembly, designated 152, that is utilized to deliver asphaltic composition to the pugmill 58. The conveyor drive assembly is comprised of the control circuit which includes the switches 122 and 146 and is further comprised of a first variable transmission 154 having an input shaft 156 that is coupled to the output shaft 158 (FIG. 5A) of an electric motor 160 that operates at constant speed during the operation of the apparatus 10. The first variable transmission 154 has a first output shaft 162 that is connected to a roller shaft 164 of the conveyor 48 via a chain 166 that engages sprockets 168 and 170 on the first output shaft 162 and the roller shaft 164 so that rotation of the first output shaft 162 in the direction 172 shown in FIG. 4 will cause the belt 54 of the conveyor 48 to move in the direction 86 shown in FIG. 3. For a purpose to be discussed below, the motor 160 that drives the first variable transmission 154 is a reversible motor so that the first output shaft 162 can be driven in the direction 174 shown in FIG. 4 to move the belt 54 of the conveyor 48 in a direction opposite the direction 86 shown in FIG. 3. (The first variable transmission 154 has been illustrated in FIGS. 1 and 2 to indicate the positioning of the first variable transmission 154 on the chassis 12. The first variable transmission 154 and the connection of the first variable transmission 154 to the conveyor 48 have been stylized in FIG. 4 to bring out the operational characteristics of the conveyor drive assembly 150. A shroud 176, as shown in FIGS. 2 and 3, surrounds the chain 166 by means of which the first output shaft 162 of the first variable transmission 154 is connected to the roller shaft 164 of the conveyor 48.

The first variable transmission 154 is preferably a Reeves vari-speed transmission manufactured by Reliance Electric of Cleveland, Ohio, such transmission including split sheaves (indicated schematically at 173 in FIG. 5A) mounted on the input shaft 156 and first output shaft 162 and connected by a belt (indicated schematically at 175 in FIG. 5A) s that the first output shaft 162 will turn in response to a rotation of the input shaft 156. The sheaves in the first variable transmission 154 are split perpendicularly to their axes so that the ratio of the speed of the first output shaft 162 to the speed of the input shaft 156 can be varied by coordinately adjusting the separations of the two halves of the two sheaves within the transmission 154. Such separation is carried out by an internal speed control assembly that includes a split sheave positioner 177 (schematically indicated in FIG. 5A) and a gear motor 178 (FIG. 5A) that drives the split sheave positioner 177 to increase the ratio of the speed of the first output shaft 162 relative to the speed of the input shaft 156 in response to a first electrical adjustment signal supplied on a conductor 180 (FIG. 5A) and to decrease the speed of the first output shaft 162 relative to the speed of the input shaft 156 in response to a second electrical adjustment signal supplied to the speed control assembly of the transmission 154 on a conductor 182 shown in FIG. 5A. The first variable transmission 154 is further provided with a second output shaft 184 that is connected via gears (not shown) to the first output shaft 162 so that the first and second output shafts 162, 184 turn at speeds bearing a fixed ratio one to another. A sheave 186 is mounted on the second output shaft 184 and a belt 188 passes over the sheave 186 and a sheave 190 that is mounted on an input shaft 192 of a second variable transmission 194 that similarly has an output shaft 196 connected to the input shaft 192 via a belt passing over split sheaves so that the separation between the halves of the sheaves can be adjusted to adjust the ratio of the speed of the output shaft 196 to the speed of the input shaft 192. (The split sheaves and belt of the second variable transmission have been schematically indicated at 193 and 195 respectively, in FIG. 5A.) As in the case of the first variable transmission 154, the second variable transmission 194 is commercially available and includes a speed control assembly that comprises a split sheave positioner 197 driven by a gear motor 198 (FIG. 5A) that can be operated to cause the split sheave positioner to adjust the sheaves in the transmission 194 to cause the speed of the output shaft 196 to increase in relation to the speed of the input shaft 192 in response to a first electrical adjustment signal supplied on a conductor 200. Alternatively, the gear motor 198 can be supplied with a second electrical adjustment signal on a conductor 202 and, in such case, the speed control assembly of the second variable transmission 194, including the gear motor 196, will adjust the spacing of the sheaves in the second variable transmission 194 to cause the speed of the output shaft 196 to decrease in relation to the speed of the input shaft 192. The output shaft 196 of the second variable transmission 194 is coupled directly to the pump 60 that receives asphaltic composition via a conduit indicated schematically at 206 in FIG. 4 and discharges the asphaltic composition on a conduit, indicated schematically at 208 in FIG. 4, extending from t e pump to the spray bar 62. The pump 60 is a constant displacement pump so that the rate at which liquid asphaltic composition is delivered to the spray bar 62 will be directly proportional to the speed of rotation of the output shaft 196 of the second variable transmission 194. During operation of the apparatus 10, the conduit 206 from which the pump 60 draws asphaltic composition is connected to an outlet on a tank truck (not shown) that provides a constant supply of asphaltic composition during the refurbishing of a roadway. A valve 210 is disposed in the conduit 208 to provide for manual control of the pumping of the asphaltic composition into the pugmill 58. (The position of the pump 60 and the second variable transmission 194 on the chassis 12 have been indicated in FIGS. 1 and 2.)

A flow meter 212 having a digital readout device on the operator's console 84 is disposed in the conduit 208 and a belt speed meter 214, similarly having a digital readout device on the operator's console 84, is connected to the shaft 162. The belt speed meter is thus mechanically coupled to the roller shaft 164 of the conveyor 48 to permit the operator of the apparatus 10 to adjust the ratio of aggregate to asphaltic composition introduced into the pugmill 58 in a manner that will be discussed below.

Figure 5:
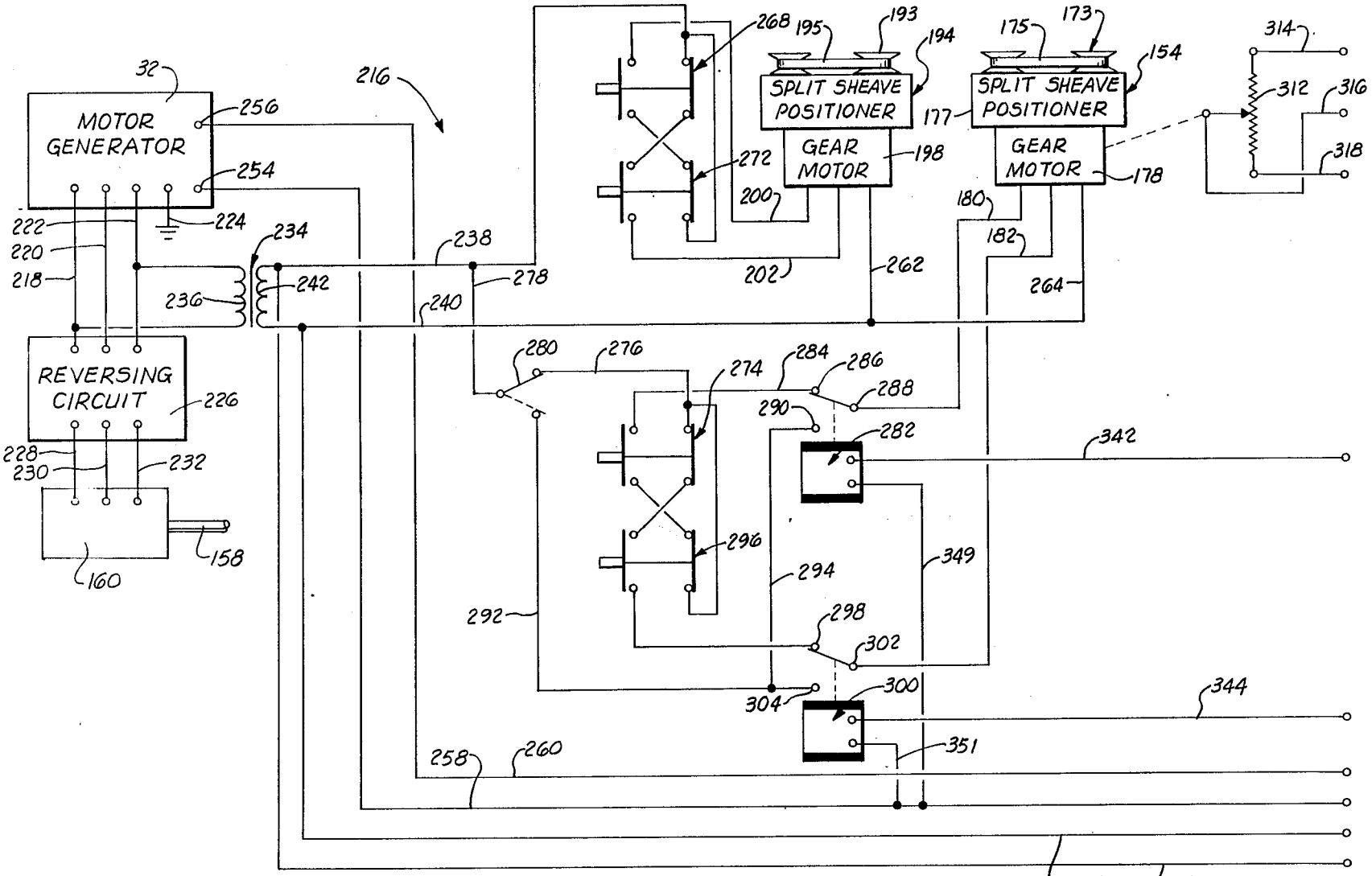
FIGS. 5A and 5B illustrate the control circuit by means of which the level of aggregate in the surge bin is maintained between pre-selected limits.
Figure 5:
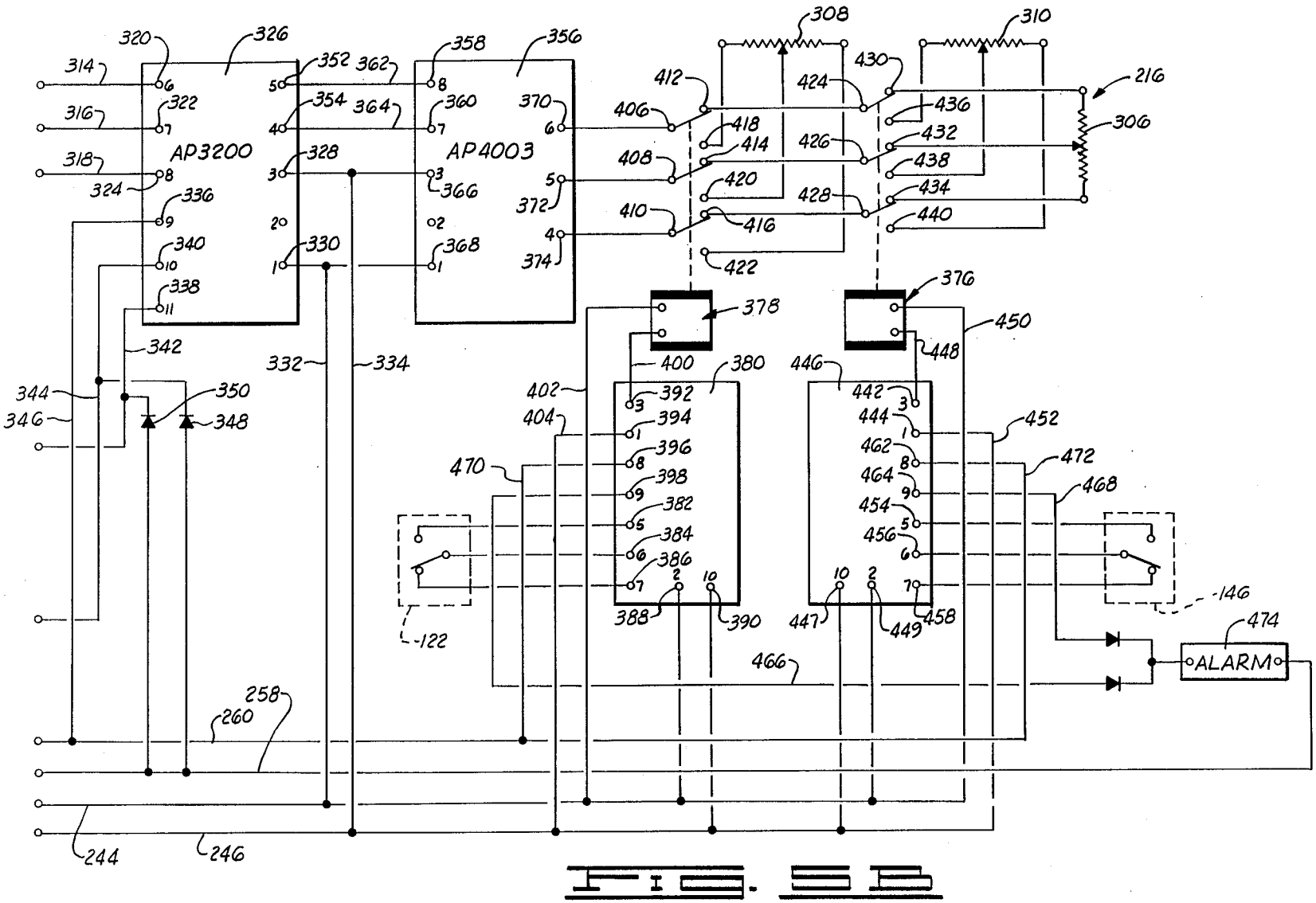

Turning now to FIGS. 5A and 5B, shown therein and designated by the general reference number 216 is the control circuit that is utilized to control the operation of the first and second variable transmissions, 154 and 194 respectively, to adjust the speed ratios between the output shafts of the variable transmissions and the input shafts thereof. Referring first to FIG. 5A, the control circuit 216 receives power from the motor generator 32 which provides three-phase 480 volt alternating current on conductors 218–222, the voltages on the conductors 218–222 being referred to a system ground connected to the motor generator 32 via a conductor 224. The conductors 218–222 are connected to a conventional reversing circuit 226 and conductors 228–232 connect the reversing circuit 226 to the motor 160 that drives the first variable transmission 154. (The reversing circuit 226 is operated by a push button switch, not shown, that is located on the operator's console so that the motor shaft 158 can be rotated in a direction to move the conveyor belt in a direction opposite the direction 86 shown in FIG. 3.) The gear motors 178 and 198 in the variable transmissions 154 and 194 respectively, are operated from 115 volt alternating current and an electrical supply to operate the gear motors 178, 198 is provided by a step-down transformer 234 having a primary winding 236 connected between two of the conductors; that is, conductors 218, 222, via which the motor generator supplies power to the reversing circuit 226. The requisite 115 volt alternating current is then provided on conductors 238, 240 that are connected to the secondary winding 242 of the transformer 234. Additional components of the control circuit 216 that will be discussed below are similarly operated from 115 volt alternating current and conductors 244 and 246 are provided to supply these additional components. The conductors 244 and 246 carry from FIG. 5A into FIG. 5B in order to illustrate the connection of the remaining components to the secondary winding 242 of the transformer 234. Additionally, selected components of the control circuit 216 are constructed to be operated from a 24 volt direct current supply and the battery (not shown) of the motor generator 32 provides a convenient source for such direct current. In FIG. 5A, the connection to the motor generator battery has been schematically indicated by the connection of conductors 258 and 260, via which direct current is supplied to components of the circuit 216, to terminals 254 and 256 of the motor generator 32.

The conductor 240 is connected to common terminals (not shown) of the gear motors 198 and 178 via conductors 262 and 264 respectively, to provide a return electrical path for the adjustment signals supplied to the gear motors on the conducting paths 200, 202 (for the gear motor 198) and 180, 182 (for the gear motor 178). Thus, by connecting a selected one of the conductors 180, 182 to the conductor 238, the speeds of the output shafts 162, 164 of the first variable transmission 154 can be increased or decreased to increase or decrease the speed of operation of the conveyor 48. Similarly, by connecting a selected one of the conductors 200, 202 to the conductor 238, the output shaft 196 of the second variable transmission can be selectively increased or decreased to increase the rate of operation of the pump 60.

The control circuit 216 is provided with a capability for both manual adjustment of the speeds of the conveyor 48 and the pump 60 and for automatic adjustment of the speed of the conveyor 48. Referring first to the speed control for the pump 60, the manual adjustment of the speed of the output shaft 196 of the second variable transmission 194 can be increased by closing a manually actuable first pump control switch 268 to connect the conductor 238 to the conductor 200 via the switch 268. Similarly, the speed of the output shaft 196 of the second variable transmission 194 can be decreased using a manually actuable second pump control switch 272 to the conductor 238 to the conductor 202. As can be seen in FIG. 5A, the first and second pump control switches, 268 and 272 respectively, are pushbutton switches that are wired together so that only one of the switches 268, 272 can be closed at one time. The switches 268 and 272 are located on the operator's console 84 and are used to adjust the ratio of aggregate to asphaltic composition introduced into the pugmill 58 in a manner that will be discussed below.

The manual adjustment of the speeds of the output shafts 162 and 184 of the first variable transmission 154 is similarly carried out by means of pushbutton switches that are located on the operator's console 84. In particular, the circuit 216 is comprised of a manually actuable first conveyor control switch 274 that is connected to the conductor 238 via conductors 276 and 278 and a selector switch 280 and is connected to the conductor 180 leading to the gear motor 178 via the contacts of a relay 282 and a conductor 284. As shown in solid line in FIG. 5A, the selector switch 280 can be positioned to provide a connection between the switch 274 and the conductor 238 and the switch 274 is connected to a terminal 286 of the contacts of the relay 282 that is normally connected to the common terminal 288 of the relay 282 contacts and the conductor 180 is connected to the common terminal 288. Thus, when the selector switch 280 is positioned as shown in solid line in FIG. 5A and the first conveyor control switch 274 is depressed, a first electrical adjustment signal as defined above is provided on the conductor 180 via the selector switch 280, the first conveyor control switch 274 and normally closed elements of the relay 282 contacts to increase the speed of the output shafts of the first variable transmission 154 and, thereby, of the conveyor 48 and pump 60. The selector switch 280 can also be thrown to a position shown in dashed line in FIG. 5A to connect the terminal 290 of the relay 282 contacts to the conductor 238, via conductors 292 and 294, so that energization of the relay 282 will provide the first electrical adjustment signal on the conductor 180 when the coil of the relay 282 is energized.

The circuit 216 similarly comprises a manually actuable second conveyor control switch 296 that is similarly connected to the selector switch 280 and to a terminal 298 of the contacts of a relay 300, the terminal 298 being normally closed with a common terminal 302 to which the conductor 182 is connected, so that, at such times that the selector switch 280 is positioned as shown in solid line in FIG. 5A, closure of the second conveyor control switch 296 will provide a connecting path between the conductor 238 and the conductor 182 to provide the second electrical adjustment signal used to slow down the output shafts 162 and 184 of the first variable transmission 154 and thereby slow the conveyor 48 and, via the connection between the variable transmissions 154 and 194, the pump 60. A third terminal 304 of the relay 300 contacts, closable with the terminal 302 when the coil of the relay 300 is energized, is connected to the conductor 292 so that, when the selector switch 280 is moved to the position shown in dashed line in FIG. 5A, the second electrical adjustment signal will be supplied to the gear motor 178, to adjust the speed at which the output shafts of the first variable transmission 154 rotate, by energizing the coil of relay 300. The selector switch 280 and the first and second conveyor control switches, 274 and 296 respectively, are located on the operator's console 84 so that the operator of the apparatus 10 can select manual or automatic control of the speed of operation of the conveyor 48 and, when manual control has been selected, can increase or decrease the speed of operation of the conveyor 48 by closing a selected one of the switches 274, 296. As in the case of the switches 268 and 272 that control the speed adjustment of the second variable transmission 194, the switches 272 and 274 are interconnected so that only one of the switches 274, 296 can complete a circuit between the conductor 238 and one of the conductors 180, 182 at one time.

Automatic control of the conveyor speed 48 is effected via a comparison between one of three potentiometers 306, 308 and 310 shown in FIG. 5B with a potentiometer 312, shown in FIG. 5A, that is mechanically coupled to the gear motor 178 so that the ratio of the resistances of the two sides of the potentiometer 312 (to either side of the wiper arm thereof) will change during operation of the gear motor 198 to adjust the speeds of the output shafts 162, 184 of the first variable transmission 154. In particular, the ends of the potentiometer 312 and the wiper arm thereof are connected via conductors 314–318 to three terminals 320–324 of a type AP3200 valve-positioner/controller 326 manufactured by Action Instruments Co., Inc., 8601 Arrow Drive, San Diego, Calif. 92123. (For completeness of disclosure of the connection of the valve-positioner/controller 326 in the circuit 216, the manufacturer's terminal numbers for the valve-positioner/controller 326 have been shown in FIG. 5B.) The valve-positioner/controller 326 is an active device that is operated by 115 volt alternating current power supplied to terminals 328, 330 thereof and such power supply is provided via conductors 332, 334 that connect to the conductors 244, 246 leading, as shown in FIG. 5A, to the secondary winding 242 of the transformer 234. The valve-positioner/controller 326 has a common contact terminal 336 which can be connected internally of the valve-positioner/controller 326 with either one of terminals 338 or 340 that are connected, via conductors 342 and 344 respectively, to the coils of the relays 282 and 300 respectively. The terminal 336 is connected via a conductor 346 to the conductor 260 leading to the positive terminal of the motor generator battery and the coils of the relays 282 and 300 are connected, via conductors 349 and 351 respectively, to the negative terminal of the motor generator battery so that the coil of the relay 282 can be energized by an internal connection between the terminals 336 and 338 in the valve-positioner/controller 326 and the coil of the relay 300 can be energized via an internal connection between the terminals 336 and 340 internally of the valve-positioner/controller 326. The contacts in the valve-positioner/controller 326 are protected via diodes 348 and 350 that are connected between the terminals 338 and 340 and the conductor 258 leading to the negative terminal of the motor generator battery, as is conventional in the art. The valve-positioner/controller 326 is constructed to compare the ratio of the resistances of the portions of the potentiometer 312 to either side of the wiper arm thereof to a direct current signal supplied to the valve-positioner/controller 326 at terminals 352 and 354 of the controller 326. At such times that the ratios of the resistances of the two portions of the potentiometer 312 to either side of the wiper arm thereof do not correspond to the electrical signal supplied to the terminals 352 and 354, the terminal 336 of the controller 326 is closed with one of the terminals 338, 340, the terminal 338 or 340 with which the terminal 336 is closed depending on the direction of mismatch between the resistance ratio and the signal supplied to the terminals 352, 354. The electrical signal that is supplied to the controller 326 at the terminals 352 and 354 is generated by a type AP4003 potentiometer conditioner 356 having output terminals 358 and 360 that are connected to the terminals 352 and 354 via conductors 362 and 364 respectively. Like the controller 326, the conditioner 356 is an active device manufactured by Action Instruments Co., Inc. of San Diego, Calif. and has power terminals 366, 368 that are connected to the 115 volt AC power supply provided by the transformer 234 via the conductors 332, 344 and the conductors 244, 246.

The potentiometer conditioner 356 generates a DC signal at the output terminals 358, 360 thereof that is representative of the setting of a potentiometer that is connected to three input terminals 370–374 of the conditioner 356. In particular, if the wiper arm of a potentiometer is connected to the terminal 372 of the conditioner 356, and the ends of the potentiometer are connected to the terminals 370 and 374, a direct current signal indicative of the ratio of resistances between the potentiometer wiper arm and the ends thereof will appear at the output terminals 358 and 360 of the conditioner 356. Thus, the controller 326 and conditioner 356, connected as shown in FIG. 5B, provide a bridge for comparing the position of the wiper arm of a potentiometer connected to the terminals 370–374 with the position of the wiper arm of the potentiometer 312 shown in FIG. 5A.

In the automatic mode of operation of the apparatus 10, the three potentiometers 306–308 are alternatively connected to the input terminals 370–374 of the conditioner 356 depending upon the level of aggregate in the surge bin 46. In particular, at such times that the level of aggregate is between the pre-selected high and low levels, the potentiometer 306 is connected through the contacts of relays 376 and 378 to the terminals 370–374 of the conditioner 356 to establish the normal speed of operation of the conveyor 46 and the pump 60 referred to above.

Should the level of aggregate in the surge bin 46 rise to the pre-selected high level that closes the switch 122, the switch 122 will close, as discussed above, to provide a high level detection signal that actuates a time delay relay 380 to which the switch 122 is connected, as shown in FIG. 5B, at terminals 382–386 of the time delay relay 380. The time delay relay 380 is a conventional delay on release relay that is operated by 115 volt alternating current power supplied to terminals 388 and 390 thereof to provide a short circuit between terminals 392 and 394 and between terminals 396 and 398 thereof when a short circuit is provided between the terminals 382 and 384 thereof; that is, in response to the high level detection signal. The coil of the relay 378 is connected in series with a set of contacts in the relay 380, between terminals 392 and 394, and the serial connection of the coil of relay 378 and such contacts in the time delay relay 380 is connected across conductors 244 and 246 leading to the secondary winding 242 of the transformer 234 via conductors 400–404. Accordingly, should the level of aggregate in the surge bin 46 reach a level sufficient to close the switch 122, the coil of relay 378 will be energized to transfer the connections made by the contacts of the relay 378 from a connection between common terminals 406–410, that are connected to the terminals 370–374, and terminals 412–416 to a connection between common terminals 406–410 and terminals 418–422 to which the potentiometer 308 is connected. Thus, the position of the wiper arm of the potentiometer 308 is compared to the position of the wiper arm of potentiometer 312 in response to a high level detection signal. The wiper arm of potentiometer 308 is positioned to correspond to a position of the wiper arm of potentiometer 312 that will occur when the gear motor 178 has positioned the split sheaves 173 for a high rate of rotation of the first variable transmission output shafts relative to the rotation rate of the first variable transmission input shaft. Thus, the high level detection signal causes both the conveyor 48 and pump 60 to have a high rate of operation.

The terminals 412–416 of the relay 378 are connected to common terminals 424–428 of the contacts of relay 376, the common terminals 424–428 being engaged with terminals 430–434 when the coil of the relay 376 is not energized. When the coil of relay 376 is energized, the common terminals 424–428 of the contacts thereof are connected to terminals 436–440 to which the potentiometer 310 is connected. The wiper arm of the potentiometer 310 is positioned such that a corresponding position in the potentiometer 312 will occur when the gear motor 178 has positioned the sheaves 173 for a low rate of speed of the output shafts of the first variable transmission 154 relative to the input shaft thereof. The coil of the relay 376 is connected, through terminals 442, 444 of a time delay relay 446 that is identical to the time delay relay 380, to the transformer 234 via the conductors 258 and 260 and conductors 448–452, the relay 446 being operable via the connection of terminals 447 and 449 thereof to the conductors 244 and 246 leading to the secondary winding 242 of transformer 234. The switch 146 that is used to detect the selected low level of aggregate in the surge bin 46 is connected to terminals 454–458 of the time delay relay 456 in the same manner that the switch 122 is connected to the terminals 382–386 of the time delay relay 380. Accordingly, at such times that the switch 146 is closed to provide a low level detection signal to the time delay relay 446, the coil of relay 376 will be energized to cause a low speed of operation of the conveyor 48 and pump 60.

The terminals 436–440 of the contacts of relay 376 are connected to the potentiometer 306 which is adjusted to a position which, if reflected in the potentiometer 312, occurs when the gear motor 178 has positioned the sheaves 173 of the first variable transmission 154 for speeds of rotation of the output shafts 162 and 184, relative to the speed of the input shaft 156, near the center of their speed ranges. Thus, in the absence of a detection signal from one of the switches 122, 146, the potentiometer 312 will be compared to potentiometer 306 which is set for a normal operating speed for the conveyor 48 and pump 60. In response to a high level detection signal that actuates relays 380 and 378, the potentiometer 312 will be compared to the potentiometer 308 which is set for a high speed of operation of the conveyor 48 and pump 60. In response to a low level detection signal that actuates relays 446 and 376, the potentiometer 312 will be compared to the potentiometer 310 which is set for a low speed of operation of the conveyor 48 and pump 60. The terminals 336 and 338 of the controller 326 are connected to the relays 282 and 300 to operate the relays 282, 300 so as to cause first or second adjustment signals to be transmitted to the gear motor 178 to adjust the resistance ratio of the potentiometer 312 to the resistance ratio of the potentiometer connected to terminals 370 and 374 of the conditioner 356, and thereby adjust the speed ratio of the input and output shafts of the first variable transmission 154, so that the conveyor and pump will operate at a normal speed determined by the potentiometer 306 in the absence of either high or low level detection signal, the conveyor and pump will operate at a high speed determined by the potentiometer 308 in response to a high level detection signal, and the conveyor and pump will operate at a low speed determined by the potentiometer 310 in response to a low level detection signal.

As noted above, the time delay relay 380 also has terminals 394 and 396 that are internally connected when the relay 380 is actuated and a similar set of terminals 462, 464 are provided in the relay 446. The terminals 396 and 398 and 462 and 464 provide parallel connections between the conductor 260 leading to one terminal of the motor generator battery via conductors 466–472, to an alarm 474 which is electrically connected to the conductor 258 leading to the other terminal of the motor generator battery. Thus, when either of the time delay relays 380, 446 is actuated by a fall of the level of aggregate in the bin to the pre-selected low level or a rise of aggregate in the bin to the pre-selected high level, the alarm 474 will be sounded to alert the operator of the apparatus 10 to such fact. The relays 380, 446 are chosen to be time delay relays of the delay on release type so that, should the level of aggregate in the surge bin 46 reach one of the pre-selected high and low levels, causing an increase or decrease in the speed of the conveyor 48 and pump 60 as will be discussed below, the change in speed of the conveyor 48 and pump 60 will be maintained for a selected length of time set into the time delay relays 380, 446 to prevent rapid cycling in adjustments to the operating rates of the conveyor 48 and pump 60. For a reason to be discussed below, the potentiometer 306 is located on the operator's console 84 so that the operator of the apparatus 10 can reset the normal speed of operation of the conveyor 48 and pump 60 at any time.

Figure 7:
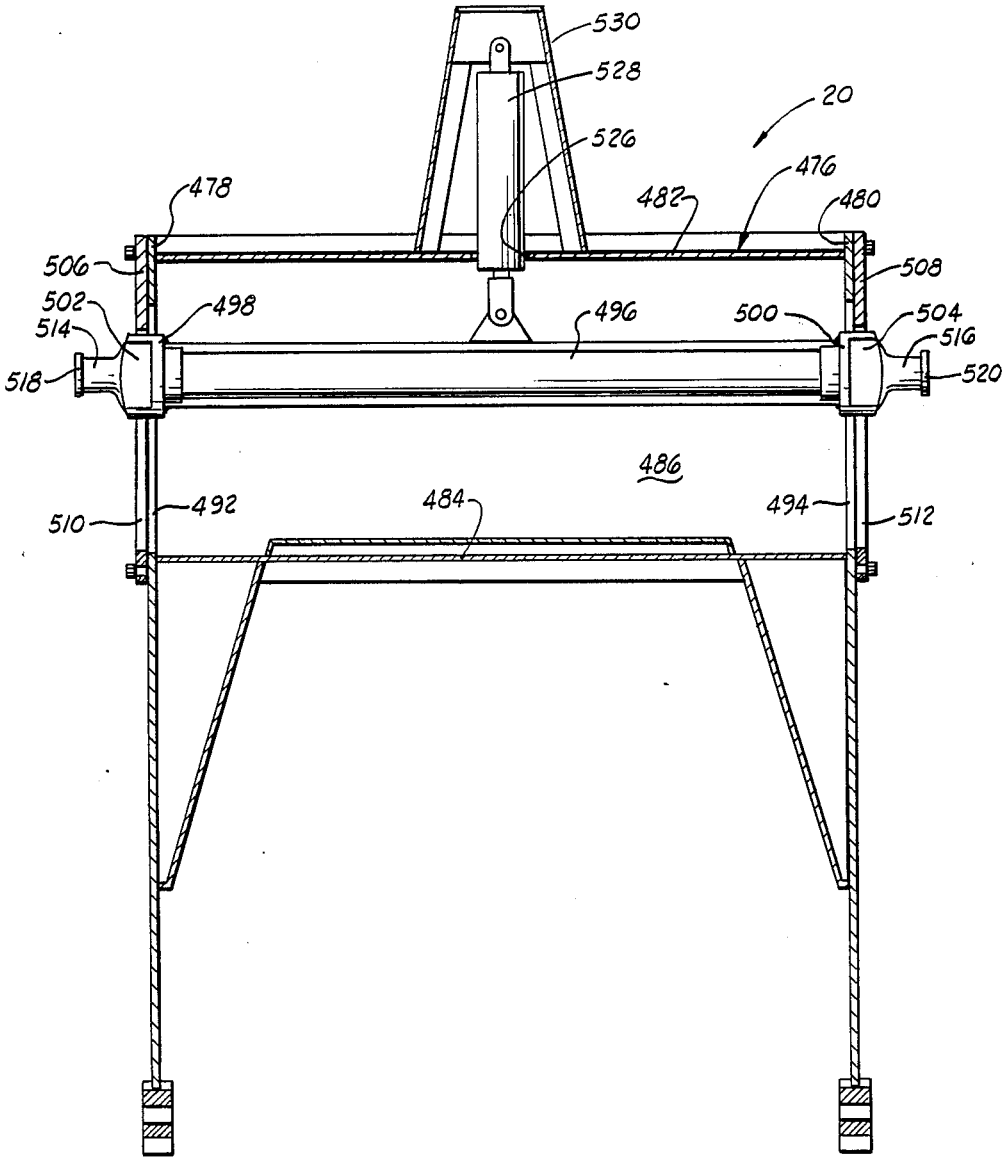
FIG. 7 is a cross-section of the coupling assembly taken along line 7—7 of FIG. 6.

The coupling assembly 20 has been illustrated in FIGS. 6 and 7 to which attention is now invited. In general, the coupling assembly 20 is comprised of a towbar support frame 476 having a generally box-like structure formed by parallel, spaced-apart side walls 478 and 480 that are connected together by parallel, spaced-apart horizontal connecting webs 482 and 484, at the top of the frame 476 and in medial portions thereof respectively, a rear plate 486 that extends between the side walls 478 and 480 and the webs 482 and 484, and a front plate (not shown) that extends between the side walls 478, 480 and walls 482 and 484 parallel to the rear plate 486 in the same manner that the rear plate 486 extends between the walls 478, 480 and webs 482, 484. Apertured lugs 488, 490 are welded to the outside surface of the rear wall 486, as shown in FIG. 6, to provide a means of mounting the coupling assembly 20 on the rear end of a roadway planing machine 18.

As shown in FIG. 7, apertures 492 and 494 are formed through the side walls 478 and 480 respectively, so that a towbar 496 can be extended side-to-side through the towbar support frame 476. The towbar 496 has enlarged portions 498, 500 near the ends thereof and the apertures 492, 494 are sized to permit passage of the enlarged portions 498, 500 through the apertures 492, 494. Two parallel flats are formed on each of the enlarged portions 498, 500, only one flat on each portion 498, 500 being shown in the drawings and designated by the numerals 502, 504 in FIG. 7. Retaining plates 506, 508, having apertures 510, 512 respectively formed therethrough sufficiently wide to receive the flats 502, 504 but not remaining portions of the enlarged portions 498, 500, are bolted to the side walls 478, 480 to retain the towbar 496 within the towbar support frame 476. Reduced diameter hubs 514, 516 are formed on portions of the towbar 496 protruding from the sides of the towbar support frame 476 and endcaps 518, 520 having slightly larger diameters than the hubs 514 and 516 are disposed at the two ends of the towbar 496. The hubs 514, 516 and the endcaps 518, 520 permit the rapid connection of the chassis 12 to the towbar 496. In particular, each base beam of the chassis 12 terminates at the forward end of the apparatus 10 in a connector having a U-shaped notch cut in the lower edge thereof, the connector 522 on the end of the base beam 22 being shown in FIG. 6, so that the notch in the lower edge of the connector can be placed on one of the hubs 514, 516 as indicated in FIG. 6. A block, such as the block 524 shown in FIG. 6, can then be bolted to the underside of the connector 522, and a similar block can be bolted to the underside of the connector (not numerically designated in the drawings) on the end of the base beam 24 to capture the hubs upon which the connectors are mounted.

Figure 8:
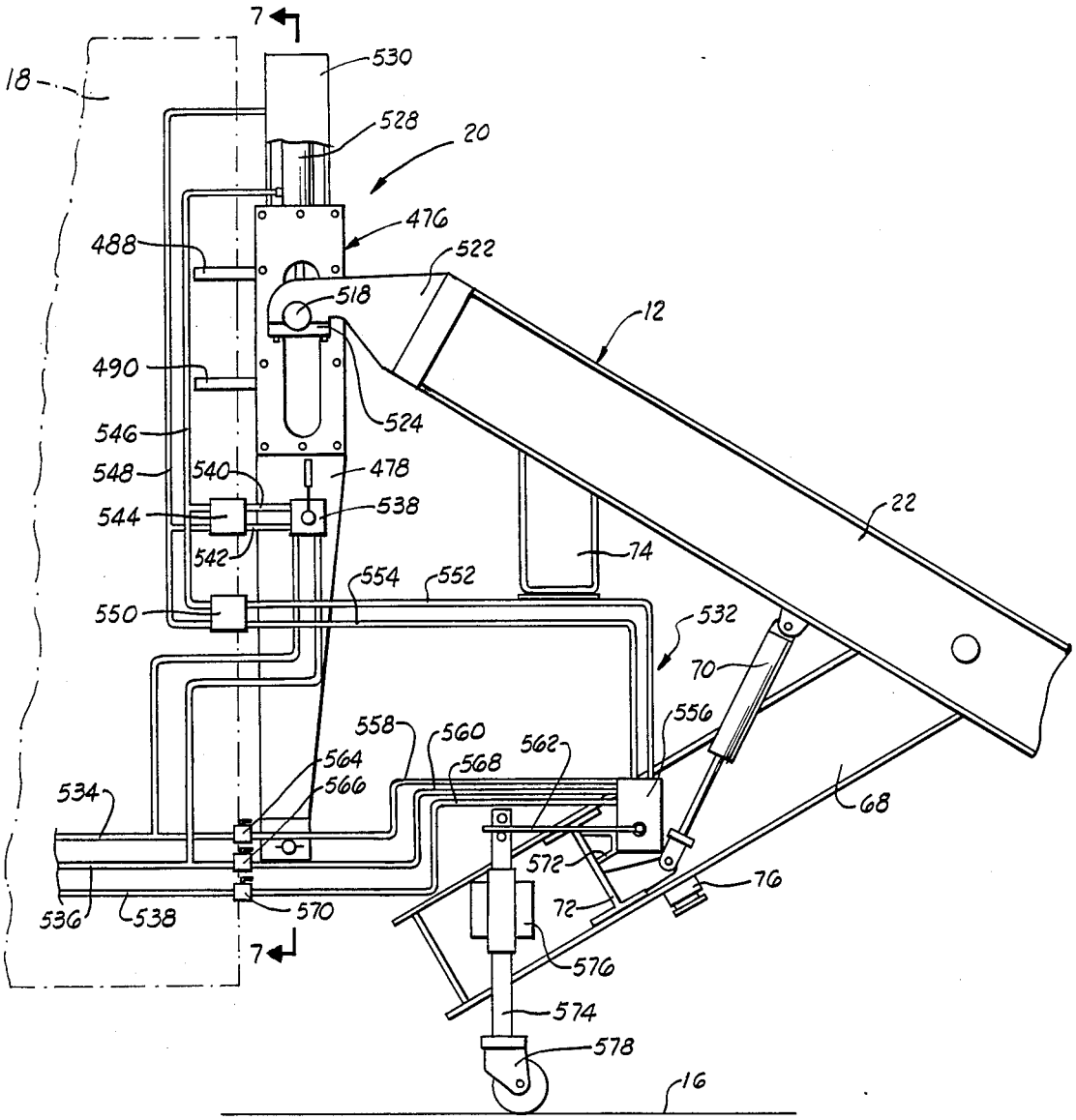
FIG. 8 is a schematic diagram of a hydraulic circuit utilized to maintain the cold mix asphalt apparatus level as the apparatus is drawn along the roadway.
Figure 9:
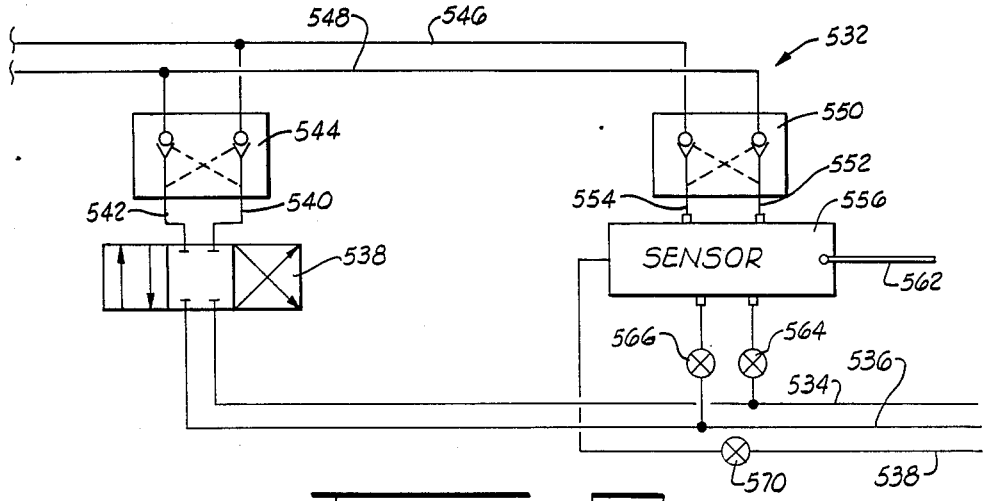

A hole 526 is cut in the center of the web 482 at the top of the towbar supporting frame 476 to permit portions of a hydraulic actuating cylinder 528, supported by a framework 530 welded to the upper side of the web 482, to be extended into the interior of the towbar supporting frame 476 and connected to the towbar 496 in a conventional manner. The hydraulic actuating cylinder 526 moves the towbar 496 vertically within the towbar support frame 476 to position the height of the forward end of the chassis 12 of the apparatus 10 above the roadway 16. To this end, the apparatus 10 is provided with a hydraulic control circuit 532 that has been illustrated in FIG. 6 and schematically diagrammed in FIG. 8.

The hydraulic control circuit 532 can be operated from any convenient source of pressurized hydraulic fluid and a preferred source is the hydraulic system with which the roadway planing machine 18, when constructed in the manner described in the aforementioned U.S. Pat. No. 4,325,580, is equipped. In such case, the hydraulic control circuit 532 is provided with a pressure line 534, an exhaust line 536 and a drain line 538 that connect to the hydraulic system of the roadway planing machine 18 in a conventional manner. The pressure and exhaust lines 534 and 536 are connected to a manually operable, closed center four-way valve 538 that is mounted on the side wall 478 of the towbar support frame 476, the valve 538 being operable to provide pressurized hydraulic fluid from the pressure line 534 on a selected one of conduits 540, 542 while connecting the other of the conduits 540, 542 to the exhaust line 536. The conduits 540, 542 are connected to a check valve 544 that opens in response to pressure at either one of the conduits 540, 542 but closes when the valve 538 is closed. The check valve 544 provides fluid communication between the conduits 540 and 542 and conduits 546 and 548 respectively that lead to the hydraulic actuating cylinder 528 so that the valve 538 can be used to provide pressurized hydraulic fluid to the hydraulic actuating cylinder 528 to vertically position the towbar 496 in the towbar support frame 476, thereby positioning the height of the forward end of the chassis 12 above the roadway 16.

The conduits 546 and 548 are also connected to a second check valve 550 which is similarly constructed to permit pressurized hydraulic fluid to be supplied from the check valve 550 to the hydraulic actuating cylinder 528, on either of the conduits 546, 548, while draining the other of the conduits 546, 548, at such times that pressurized hydraulic fluid is supplied on either one of conduits 552 and 560 to which the check valve 550 is fluidly connected. The conduits 552, 554 are fluidly connected to a sensor 556 which can conveniently be a sensor designated by the numeral 72 in U.S. Pat. No. 3,774,401, issued Nov. 27, 1973 to Allen. Sensors of this type are constructed to receive pressurized hydraulic fluid on a conduit 558 and transmit such fluid to one of the conduits 552, 554, while exhausting the other of the conduits 552, 554 via a conduit 560 in proportion to the displacement of a pivotable wand 562 that extends from the case (not numerically designated in the drawings) of the sensor 556 from the horizontal position of the wand 562 shown in FIG. 6. The conduits 558 and 560 are connected through valves 564 and 566 respectively, to the pressure and exhaust lines 534 and 536 so that the sensor 556 can be utilized to control the transmittal of pressurized hydraulic fluid to the hydraulic actuating cylinder 528, and the exhaust of hydraulic fluid from the hydraulic actuating cylinder 528, to control the vertical height of the forward end of the chassis 12 above the roadway 16. A third conduit 568 is connected through a valve 570 to the drain line 538 to prevent the buildup of pressure inside the case of the sensor 556. The case of the sensor 556 is detachably supported on the towing frame 68 via a bracket 572 such that the wand 562 extends forwardly of the case of the sensor 556 to be engaged by pins or the like on a shaft 574 that is slidably mounted in a second bracket 576 mounted on the side of the towing frame 68. The shaft 574 terminates at its lower end in a caster 578 that rolls along the roadway 16. Thus, the sensor 556, shaft 574, and caster 578 form a height sensor for the forward end of the chassis 12 that can be connected between the hydraulic actuating cylinder 528 and the hydraulic circuit of the roadway planing machine, via the valves 564, 566 and 570, to automatically position the height of the forward end of the chassis 12 above the roadway 16. That is, the sensor 556 will provide pressurized hydraulic fluid on the appropriate conduit 552, 554, and thence to the appropriate conduit 546, 548, to proportionally reposition the height of the chassis 12 in response to a displacement of the wand 562 from the position that has been shown in FIG. 6.

OPERATION OF THE PREFERRED EMBODIMENT

In the preferred use of the apparatus 10, the apparatus 10 is towed behind a roadway planing machine 18 during planing operations to concurrently produce cold mix asphalt from material planed from the roadway 16 and deposit such asphalt on the roadway 16 for respreading of the asphalt. To carry out this use, the apparatus 10 is towed to a work site while the towing frame 68 is bolted to the post 74 and the corresponding post (not shown) on base beam 24 and the jacks 78 are lowered to engage the roadway 16 so that the towing vehicle can be detached from the apparatus 10 and moved away therefrom. The towing frame 68 is then unbolted from the posts depending from the base beams 22, 24 and, after mounting the shaft 574 on the bracket 576, lowered to the position shown in FIG. 6 by means of the hydraulic actuating cylinder 70. With the towing frame 68 in such position, the roadway planing machine 18 can be backed toward the forward end of the apparatus 10 so that the discharge conveyor 21 enters the separation between the base beams 22, 24 of the chassis 12 to extend above central portions of the apparatus 10 as has also been shown in FIG. 2. (Prior to such backing, the towbar 496 will have been positioned near the lower end of the apertures 510, 512 in the retaining plates 506, 508 so that the ends of the towbar will be below the connectors, such as the connector 522, on the ends of the base beams 22, 24 while the roadway planing machine 18 is backed into position.) The sensor 556 is then mounted on the bracket 572 and the conduits 534–538 are connected to the hydraulic circuit of the roadway planing machine 18. The manually operated valve 538 is then operated to raise the towbar 496 to engage the ends of the towbar 496 with the connectors, such as the connector 522, on the ends of the base beams 22, 24 of the chassis 12 and the base beams 22, 24 are secured to the ends of the towbar 496 via the blocks, such as the block 524, that can be bolted to the connectors at the ends of the base beams 22, 24. The valves 564, 566 and 570 can then be opened to permit automatic control of the height of the forward end of the chassis 12 at such times that the apparatus 10 is drawn along the roadway 16 by the roadway planing machine 18.

After the apparatus 10 has been connected to the towbar 496, the gate 88 is positioned on the rear wall 52 of the surge bin 46 by turning the shaft 110 to provide a selected separation between the lower edge 132 of the gate 88 and the belt 54 of the conveyor 48. This distance is selected in accordance with such factors as the depth of cut to be taken in the roadway by the roadway planing machine 18 so that, at substantially the center of the range of speeds of which the conveyor 48 can be operated, the rate at which aggregate is delivered from the surge bin 46 will be substantially equal to the average rate at which the discharge conveyor 21 of the roadway planing machine 18 delivers material planed from the roadway 16 to the shaker screen 28. It will be noted that the rate at which material planed from the roadway 16 will generally not be constant nor will the rate at which material is passed by the screen 28 into the surge bin 46 be constant. Rather, such rates depend upon such factors as the grade and cross slope to which the roadway 16 will be planed and the sizes of pieces of material planed from the roadway 16 that are discharged by the roadway planing apparatus 18.

Following the positioning of the gate 88, the selector switch 280 is positioned as shown in solid lines in FIG. 5A to provide for manual adjustment of the speed of the output shafts of the first variable transmission 154 and operation of the motor generator 32 is commenced to provide power for the apparatus 10. At this time, the shaker screen 28, the crusher 38, the pugmill 58, and the conveyor 42, all of which are operated electrically from power supplied from the motor generator 32, can be caused to commence operation via switches (not shown) that connect the drive systems of these components of the apparatus 10 to the motor generator 32.

The roadway planing machine 18 is then driven forward to begin planing the roadway 16 and discharging the cuttings from the roadway 16 into the shaker screen 28 via the discharge conveyor 21. The cuttings are separated into aggregate that falls into the surge bin and larger pieces that are delivered to the crusher 38 and thence to the conveyor 42 to be returned to the discharge conveyor 21 of the roadway planing machine 18 so that the surge bin 46 will begin receiving aggregate from the roadway planing machine 18. Initially, the switch (not shown) that controls the reversing circuit 226 will be closed so that the motor 160 that drives the first variable transmission 154 will be operated in a direction to move the belt 54 of the conveyor 48 in a direction opposite the direction 86, shown in FIG. 3, which will cause aggregate in the surge bin 46 to be delivered to the pugmill 58. This initial period of reversal of the direction of operation of the belt 54 will suffice to load the surge bin 46 to a level between the selected high and low levels in the surge bin 46 between which the level of aggregate in the surge bin 46 is to be maintained. Once the surge bin 46 has been initially loaded, the reversing circuit 226 can be disengaged so that the motor 160 will drive the first variable transmission 154 in a direction that will cause the belt 54 to be moved in the direction 86 that transfers aggregate from the surge bin 46 to the pugmill 5B.

During these initial operations, the output of asphaltic composition will be closed off at the valve 210 so that the initial discharge of aggregate from the conveyor 48 will not be accompanied by a spraying of asphaltic composition into the pugmill 5B. Prior to the commencement of the introduction of asphaltic composition into the pugmill 58, a sample of the aggregate being carried from the surge bin 46 via the belt 54 can be taken and weighed to obtain the weight of the aggregate per unit volume. With a knowledge of the weight per unit volume, the height of the lower edge 132 of the gate SB above the belt 54, and the rate at which the conveyor 48 is being driven, as determined by the belt speed meter 214, the weight of aggregate currently being transferred from the surge bin 46 to the pugmill 58 can be determined. Preferably, the weight versus conveyor operating rate for realistic densities of the aggregate and for a selected mid-range of the operating rate of the conveyor will be tabulated and the tables will be affixed to components of the apparatus 10 that are visible from the catwalk 80 so that the operator of the apparatus 10 need only refer to the tables to determine the rate of discharge of the aggregate, by weight, for measured operating speeds of the conveyor 48. A tank truck containing the asphaltic composition is then connected to the conduit 206 leading to the inlet of the pump 60 and the valve 210 is opened so that the pump 60 can supply asphaltic composition to the pugmill 58 when the pump 60 is driven via the second variable transmission 194 which, in turn, is driven by the first variable transmission 154. Following the connection of the supply of asphaltic composition to the apparatus 10, the input to output shaft speed ratio of the second variable transmission 194 is set by selectably depressing the first and second pump control switches until the rate at which asphaltic composition is being introduced into the pugmill 58, as seen by the digital readout of the flow meter 212 on the operator's console 84, will provide a selected ratio of aggregate to asphaltic composition, by weight, in the pugmill 58. Since the second variable transmission 194 is driven by the first variable transmission 154, this ratio will be maintained for all rates of delivery of aggregate and asphaltic oil to the pugmill 58. That is, should the conveyor 48 be operated at an increased or decreased speed by adjusting the first variable transmission 154, the pump 60 will be operated at a proportionately increased or decreased speed via the drive of the second variable transmission 194 by the first variable transmission 154.

The apparatus 10 can be operated in two modes, manual and automatic. In the manual mode of operation, the selector switch 280 is maintained in the position shown in solid lines in FIG. 5A and the operator of the apparatus 10 observes the level of aggregate in the surge bin 46 and maintains such level between the pre-selected high and low levels defined by the position of the switch 122 and the position of the aggregate engagement plate 130. In particular, should the level of aggregate rise toward the paddle 126 the operator of the apparatus 10 will depress the first conveyor control switch 274 to transmit a first electrical adjustment signal on the conductor 180 to the gear motor 178 of the first variable transmission 154 to increase the speed of the first output shaft 162 of the first variable transmission relative to the input shaft 156 thereof. Accordingly, the conveyor 48 will be operated at an increased rate to increase the rate at which aggregate is transferred from the surge bin 48 to the pugmill 58. Concurrently and proportionately, the speed of the second output shaft 184 of the first variable transmisson 154 will increase to provide a proportionate increase in the rate at which the second variable transmission 194 drives the pump 60. Thus, cold mix asphalt will be produced at a higher rate but will have the same ratio of aggregate to asphaltic composition. The increased rate of operation of the conveyor 48 will lower the level of aggregate in the surge bin 46 by increasing the rate at which aggregate is delivered therefrom so that the aggregate level in the surge bin 46 is prevented from attaining the pre-selected high level.

Conversely, should the level of aggregate in the surge bin 46 approach the pre-selected low level, the operator of the apparatus 10 will depress the second conveyor control switch 296 to transmit a second electrical adjustment signal on the conductor 182 to the gear motor 178 of the first variable transmission 154 to decrease the rotation rate of the first output shaft 162 of the first variable transmission 154 relative to the speed of rotation of the input shaft 156. Thus, the conveyor 48 will be operated at a decreased rate to transfer aggregate from the surge bin 46 more slowly so that the level of aggregate in the surge bin 46 will rise. Concurrently and proportionately, the second output shaft 184 of the first variable transmission 154 will slow to slow the speed with which the second variable transmission 194 drives the pump 60 so that cold mix asphalt will be produced at a slower rate but with an unchanged ratio of aggregate to asphaltic composition.

To operate the apparatus 10 in the automatic mode, the potentiometers 306–310 need to be set to provide a normal, high and low speed of operation of the conveyor 48. Preferably, the high and low speeds of operation are set once by manually closing the switches 122 and 146 in turn, after moving the selector switch 280 to the position shown in dashed line in FIG. 5A, while observing the rate at which the conveyor 48 operates via the belt speed meter 214. To set the high speed of operation, the switch 122 is closed to actuate the time delay relay 380 and thereby energize the coil of the relay 378 so that the contacts thereof will connect the potentiometer 308 to the terminals 370–374 of the potentiometer conditioner 356. The conditioner 356 will then provide a direct current signal to the terminals 352, 354 of the valve-positioner/controller 326 that is compared, in the controller 326, to the setting of the potentiometer 312 that is mechanically linked to the gear motor 178. Should the ratios of resistance to either side of the wiper arms of the potentiometers 308 and 312 not be the same, the terminal 336 of the controller 326 will be internally connected in the controller 326 to one of the terminals 338 and 340 of the controller 326. Thus, a circuit will be completed through the coil of one of the relays 282, 300 from one terminal of the motor generator battery via the conductor 260, the conductor 346, and one of the conductors 342 or 344 depending upon which terminal 338, 340 of the controller 326 is internally connected to the terminal 336. Accordingly, when the potentiometer 308 is connected to the terminals 370–374 of the conditioner 356, and assuming that the potentiometer 312 is not set to provide the same resistance ratio to the sides of the wiper arm thereof that exists for the potentiometer 308, the coil of relay 282 will be energized to provide a first adjustment signal to the gear motor 178 via the conductors 278, 292, 294 and 180 and the contacts of the relay 282 or the coil of relay 300 will be energized to provide a second adjustment signal to the gear motor 178 via the conductors 278, 292, and 182 and the contacts of the relay 300. The wiper arm of the potentiometer 308 is then moved to a position in which the coil of relay 282 is energized, to provide a first adjustment signal to the gear motor 178, and is further adjusted so that the gear motor 178 will operate to position the sheaves 173 for a high speed of operation of the conveyor 48 when the potentiometers 308 and 312 have equal resistance ratios to the two sides of the wiper arms thereof. Such condition can be observed by observing the rate of operation of the conveyor 48 while adjusting the potentiometer 308. The low speed of operation of the conveyor 48 is similarly selected by closing the switch 146 and thereafter adjusting the wiper arm of the potentiometer 310 while observing the rate of operation of the conveyor 48. The high and low speeds of operation of the conveyor 48 can be selected to correspond to speeds of the output shafts 162 and 184 of the first variable transmission 154, relative to the speed of the input shaft 156 thereof, that differ slightly from the maximum and minimum speeds that the output shafts 162 and 184 can attain for a given speed of the input shaft 156 so that no further adjustment need ever be made to the settings of the potentiometers 308 and 310.

The setting of the normal speed of operation of the conveyor 48 is preferably carried out in situ to meet of operation. Throughout this sequence of events, the second variable transmission 194 will have been driven by the second output shaft 184 of the first variable transmission 154 so that the pumping rate of the pump 60 will increase and subsequently decrease proportionately to the speed of operation of the conveyor 48 to maintain the ratio of aggregate and asphaltic composition delivered to the pugmill 58 constant.

Should the level of aggregate in the surge bin 46 fall to the pre-selected low level determined by the position of the lower edge 132 of the gate 88, the height of aggregate on the belt 54 leaving the surge bin 46 will drop so that the aggregate engagement plate 130 will pivot downwardly from a horizontal position in which the aggregate engagement plate 130 extends parallel to the belt 54. When this occurs, the shaft 138 is moved downwardly by the spring 140 so that the collar 144 will engage the operating lever of the switch 146 and close the switch 146. Closure of the switch 146 completes a circuit between the terminals 454 and 456 of the time delay relay 446; that is, transmits a low level detection signal to the time delay relay 446, so that the time delay relay 446 is actuated. When the time delay relay 446 is actuated, an internal connection is made between the terminals 442 and 444 thereof to energize the coil of relay 376 via conductors 448, 450, 244 and 246. Thus, the contacts of the relay 376 are repositioned to connect the low speed potentiometer 310 to the terminals 370–374 of the potentiometer conditioner 356 so that the potentiometer conditioner 356 and the valve-positioner/controller 326 compare the ratios of resistances of the two sides of the potentiometer 310 to the ratio of the resistances of the two sides of the potentiometer 312. Since, prior to the fall of the aggregate level in the surge bin 46 to the pre-selected low level, the aggregate will have been at a level between the pre-selected high and low levels, the wiper arm of the potentiometer 312 will be at a position, corresponding to the normal speed of operation of the conveyor 48, that will not match the position of the wiper arm of the potentiometer 310 so that the terminal 336 of the controller 326 will become internally connected to the terminal 340 thereof to complete a circuit through the coil of the relay 300 via conductors 258, 344, 346 and 260. Thus, the coil of relay 300 will become energized to provide a conducting path between the secondary winding 242 of the transformer 234, via conductors 238, 278, 292 and 182 and the contacts of relay 300, and the gear motor 178 so that a second adjustment signal is transmitted to the gear motor 178. In response to the second adjustment signal, the gear motor 178 will be operated to position the sheaves 173 to cause the speed of the output shaft 162 of the first variable transmission 154 to decrease relative to the speed of the input shaft 156 thereof. Accordingly, the conveyor 48 will be slowed to slow the rate at which aggregate is discharged from the surge bin 46 so that the level of aggregate in the surge bin 46 can rise. Concurrently with the slowing of the conveyor 48, the wiper arm of the potentiometer 312 is repositioned to match the position of the wiper arm of the potentiometer 310.

When the level of aggregate in the surge bin 46 increases, the height of aggregate on the belt 54 will again attain the level of the lower edge 132 of the gate 88 to raise the aggregate engagement plate 130 and raise the collar 144 from the operating handle 148 of the switch 146. Accordingly, the switch 146 opens to discontinue the transmittal of the low level detection signal to the time delay relay 446 and, following a time delay upon release set into the relay 446, the relay 446 will deactuate to deenergize the coil of relay 376. The time delay set into the relay 446 will suffice to insure that the level of aggregate in the surge bin 46 rises above the low level that has been pre-selected for the surge bin 46. When the coil of relay 376 deenergizes, the contacts thereof return to the positions shown in FIG. 5B so that the normal speed potentiometer 306 is again connected to the terminals 370–374 of the potentiometer conditioner 356. Thus, the potentiometer conditioner 356 and valve-positioner/controller 326 will compare the resistance ratio of the two sides of the potentiometer 306, about the wiper arm thereof, to the resistance ratio of the two sides of the potentiometer 312. Since the wiper arm of the potentiometer 312 will have been repositioned with the split sheaves 173, the potentiometer 312 will be set for a low speed of operation of the conveyor 48 while the potentiometer 306 will be set for the higher, normal speed of operation of the conveyor 48. Accordingly, as a result of the comparison of the resistance ratios of the potentiometers 306 and 312 by the potentiometer conditioner 356 and valve-positioner/controller 326, terminal 336 of the controller 326 will become internally connected with terminal 338 thereof to form a conducting path through the coil of relay 282 via conductors 348, 342, 346, 258 and 260. Thus, the coil of relay of 282 will become energized so that the contacts thereof provide a conducting path from the secondary winding 242 of the transformer 234 to the conductor 180 that provides the first adjustment signal to the gear motor 178. In response to the first adjustment signal supplied to the gear motor 178, the gear motor 178 will cause the split sheave positioner 177 to readjust the position of the split sheaves 173 to cause the first output shaft 162 of the first variable transmission 154 to rotate at a higher rate that increases the speed at which the conveyor 48 is driven. Concurrently, the wiper arm of the potentiometer 312 is repositioned so that the speed of the conveyor 48 is brought up to the normal speed while the potentiometers 312 and 306 are balanced. Thus, the overall operation of the apparatus 10 in response to a fall of the level of aggregate in the surge bin to the pre-selected low level is a temporary decrease of the rate of operation of the conveyor 48. During this temporary decrease, the rate of operation of the pump 60 will also be decreased because of the drive of the input shaft 192 of the second variable transmission 194 from the second output shaft 184 of the first variable transmission 154. Thus, the temporary decrease in the rate of operation of the conveyor 48 will suffice to raise the level of aggregate in the surge bin so that the rate of operation of the conveyor 48 will maintain a fixed proportionality between the weight and volume of aggregate delivered to the pugmill 58 while concurrently maintaining a constant ratio of aggregate to asphaltic composition delivered to the pugmill 58.

At times, the variation in the rate at which material planed from a roadway is delivered to the surge bin 46 will be such that the normal rate of operation of the conveyor 48 will discharge aggregate from the surge bin 46 at a rate that is greater or lower than the average rate of delivery of aggregate to the surge bin 46. In such case, the level of aggregate in the surge bin 46 will remain near one of the pre-selected high or low levels and cause frequent increases or decreases in the rate of operation of the conveyor 48 and pump 60. Preferably, the level of aggregate in the surge bin 46 is maintained conditions that are unique to each job in which asphalt is planed from a roadway by the roadway planing machine 18 and converted into asphalt by the apparatus 10. Preferably, the apparatus 10 is initially operated in the manual mode so that the conveyor control switches are used to establish an adjustment of the first variable transmission 154 that will deliver aggregate from the surge bin 46 at a rate that is substantially equal to the average rate at which material planed from the roadway 16 is delivered to the surge bin 46 and the level of aggregate in the surge bin is between the pre-selected high and low levels. The speed of the conveyor 48 under these conditions is then noted on the belt speed meter 214 and the selector switch 280 is thrown to the position shown in dashed lines in FIG. 5A. Since the level of aggregate in the surge bin 46 is between the selected high and low levels, neither of the time delay relays 380, 446 will be actuated at the time the selector switch 280 is moved to the dashed-line position so that the coils of the relays 376 and 380 will not be energized and the contacts of the relays 376, 380 will connect the potentiometer 306 to the terminals 370–374 of the potentiometer conditioner 356. Thus, the potentiometer conditioner 356 and the valve-positioner/controller 326 will compare the setting of the potentiometer 306 to the setting of the potentiometer 312. In general, since the apparatus 10 will have previously been used on a job involving a different normal speed of operation of the conveyor 48, the resistance ratios of the two sides of the potentiometers defined by the positions of their wiper arms will not be the same so that an internal connection will be made between the terminal 336 and one of the terminals 338, 340 of the controller 326 to energize the coil of one of the relays 282, 300. Accordingly, either a first or a second adjustment signal will be transmitted to the gear motor 178 to reposition the sheaves 173 and increase, or decrease, the speed of the conveyor 48. The potentiometer 306 is then adjusted while observing the digital readout of the belt speed meter 214 until the coils of both relays 282, 300 are de-energized and the conveyor 48 is operating at a speed that is the same as the speed that was noted during manual operation of the apparatus 10 just prior to movement of the selector switch 280 to the position for automatic control of the apparatus 10. The apparatus 10 will now be set for automatic control of the speed of the conveyor 48 and concurrent automatic control of the speed of the pump 60 to produce cold mix asphalt having the selected aggregate-to-asphaltic composition ratio.

During automatic operation of the apparatus 10, the rate at which material is planed from the roadway 16 will vary so that, at times, the quantity of aggregate in the surge bin 46 will rise to a level sufficient to engage the paddle 126 on the high level switch 122 and close the switch 122. When this occurs, the switch 122 completes a circuit to the time delay relay 380; that is, the switch 122 will transmit a high level detection signal to the time delay relay 380, so that the time delay relay 380 will be actuated. When the time delay relay 380 actuates, an internal contact is made between the terminals 392 and 394 thereof to complete a circuit through the coil of the relay 378 via conductors 400, 402, 246 and 244. Thus, the contacts of the relay 378 will shift to a position to connect the potentiometer 308 to the terminals 370–374 of the conditioner 356 causing the conditioner 356 and the controller 326 to compare the setting of the potentiometer 312 to the setting of the high speed potentiometer 308. Since the potentiometer 312 will, at that time, be in a position, caused by the normal speed of operation of the conveyor 48, to be balanced by the potentiometer 306, the comparison of the high speed potentiometer 308 with the potentiometer 312 will cause an internal connection in the controller 326 between the terminal 336 thereof and the terminal 338 thereof to complete a circuit through the coil of relay 282 via the conductors 346, 342 and 348. Thus, the contacts of relay 282 will complete a circuit from the gear motor 178 via the conductors 278, 292, 294 and 180 and via the selector switch 280 to provide a first adjustment signal to the gear motor 178. Accordingly, the gear motor 178 will operate to reposition the sheaves 173 for an increased speed of operation of the conveyor 48 and, concurrently, to reset the position of the wiper arm of the potentiometer 312 so that the settings of the potentiometers 312 and 308 are the same. The increased speed of operation of the conveyor 48 will cause an increased rate of delivery of aggregate from the surge bin 46 so that the level of aggregate in the surge bin 46 will fall to a level that is again between the high and low levels of aggregate in the surge bin 46. As the level of aggregate in the surge bin 46 falls, the aggregate will disengage the paddle 126 to open the switch 122 and discontinue the transmittal of the high level detection signal to the time delay relay 380. Accordingly, after a time delay on release that has been set into the time delay relay 380 has elapsed, such time delay being set into the relay 380 to insure that the level of aggregate in the surge bin 46 will completely disengage the paddle 126, the time delay relay 380 will deactuate to deenergize the coil of the relay 378. When the coil of the relay 378 is deactuated, the contacts of the relay 378 will return to the position shown in FIG. 5B to again connect the normal speed potentiometer 306 to the terminals 370–374 of the potentiometer conditioner 356. At this time, the potentiometer 312 will have been adjusted for a high speed of operation of the conveyor 48 so that the settings of the potentiometers 306 and 312 will not match. Rather, the setting of the potentiometer 306 will correspond to a setting of the potentiometer 312 that corresponds to the normal speed of operation of the conveyor 48 while the actual setting of the potentiometer 312 corresponds to a high speed of operation of the conveyor 48 so that an internal connection will be made in the valve-positioner/controller 326 between the terminals 336 and 340 thereof with the result that a circuit is completed through the coil of relay 300 via conductors 344, 346, 350, 260, and 258. Thus, the coil of relay 300 will be energized to connect the conductor 182 leading to the gear motor 178 to the secondary winding 242 of the transformer 234 via conductors 238, 278, and 292. Thus, a second adjustment signal is transmitted to the gear motor 178 to cause the gear motor 178 to position the sheaves 173 to slow the speed of operation of the conveyor 48. As the speed of operation of the conveyor 48 is decreased, the potentiometer 312 is readjusted so that the slowing of the conveyor 48 continues until the conveyor 48 is again operating at the normal speed of operation. Thus, the chain of events that occurs when the aggregate rises to the pre-selected high level in the surge bin 46 is that the first variable transmission 154 is initially readjusted to cause the conveyor 48 to operate at a high speed that will lower the level of aggregate in the surge bin 46 followed by a second adjustment of the first variable transmission 154, occurring after the level of aggregate in the surge bin 46 has dropped, to return the conveyor 48 to the normal speed near the center of the surge bin 46 with only occasional movement of such level toward the pre-selected high or low level established for the surge bin. To obtain this preferable mode of operation of the apparatus 10, the operator of the apparatus 10 need only reposition the wiper arm of the potentiometer 306 which, as noted above, is mounted on the operator's console 84 when a systematic variation between the rate of delivery of aggregate from the surge bin 46 and the average rate of delivery of material planed from a roadway thereto is detected.

It is clear that the present invention is well adapted to carry out the objects and attain the ends and advantages mentioned as well as those inherent therein. While a presently preferred embodiment of the invention has been described for purposes of this disclosure, numerous changes may be made which will readily suggest themselves to those skilled in the art and which are encompassed within the spirit of the invention disclosed and as defined in the appended claims.

What is claimed is:

1. An apparatus for producing cold mix asphalt from liquid asphaltic composition and aggregate received by the apparatus at an uncontrolled rate, comprising:

a surge bin for receiving the aggregate;

a pugmill;

a conveyor operable to transport aggregate from the surge bin to the pugmill;

conveyor drive means for operating said conveyor at rates selectable to maintain the quantity of aggregate in the surge bin between selected high and low levels;

a pump operable to deliver asphaltic composition to the pugmill; and pump drive means coupling the pump to the conveyor drive means for operating the pump at a rate proportional to the rate of operation of the conveyor.

2. The apparatus of claim 1 further comprising:

an inclined screen positioned above the surge bin for grading aggregate introduced into the surge bin, said screen passing a portion of material placed thereon having a particle size smaller than a pre-selected maximum particle size while larger pieces of said material gravitate off the lower end of the screen;

crusher means, positioned with respect to said screen to receive said larger pieces of the material placed thereon, for comminuting said pieces of said material; and means for tranporting comminuted material from the crusher means to the screen positioned above the surge bin.

3. The apparatus of claim 1 further comprising a mobile chassis whereon the pugmill, conveyor, conveyor drive means, pump and pump drive means are mounted, whereby said apparatus can be towed by a roadway planing machine during roadway planing operations to receive material planed from the roadway by the roadway planing machine as said aggregate.

4. The apparatus of claim 3 wherein said roadway planing machine is characterized as having a discharge conveyor for discharging material planed from a roadway from said machine, said discharge conveyor positionable above said surge bin at such times that said apparatus is towed by the roadway planing machine; and wherein the apparatus further comprises:

an inclined screen positioned above the surge bin for receiving material planed from the roadway from the roadway planing machine discharge conveyor and passing a portion of said material having a particle size smaller than a pre-selected maximum particle size into the surge bin while larger pieces of said material gravitate off the lower end of the screen;

crusher means, positioned with respect to said screen to receive said larger pieces of the material planed from the roadway, for comminuting said pieces of said material; and means for transporting comminuted material from the crushing means to the discharge conveyor of the roadway planing machine.

5. The apparatus of claim 4 further comprising:

coupling means, mountable on the rear end of said roadway planing machine, for coupling the forward end of the chassis to the roadway planing machine, the coupling means comprising:

a tow bar support frame mounted on the roadway planing machine;

a tow bar horizontally supported on the tow bar support frame for vertical movement thereon; and a hydraulic actuating cylinder connected between the tow bar support frame and the tow bar, the hydraulic actuating cylinder operable to raise and lower the tow bar on the tow bar support frame;

means for connecting the forward end of said chassis to the ends of said tow bar; and hydraulic actuating cylinder control means comprising a height sensor mounted on the chassis for operating said hydraulic actuating cylinder to maintain the forward end of the chassis at a pre-selected height above said roadway.

6. The apparatus of claim 3 further comprising: coupling means, mountable on the rear end of said roadway planing machine, for coupling the forward end of the chassis to the roadway planing machine, the coupling means comprising:

a tow bar support frame mounted on the roadway planing machine;

a tow bar horizontally supported on the tow bar support frame for vertical movement thereon; and a hydraulic actuating cylinder connected between the tow bar support frame and the tow bar, the hydraulic actuating cylinder operable to raise and lower the tow bar on the tow bar support frame;

means for connecting the forward end of said chassis to the ends of said tow bar; and hydraulic actuating cylinder control means comprising a height sensor mounted on the chassis for operating said hydraulic actuating cylinder to maintain the forward end of the chassis at a pre-selected height above said roadway.

7. The apparatus of claim 3 wherein the conveyor drive means comprises:

a first variable transmission of the type having an input shaft, a first output shaft, and speed control means for increasing the speed of the first output shaft relative to the speed of the input shaft in response to a first electrical adjustment signal supplied to said speed control means and decreasing the speed of the first output shaft relative to the speed of the input shaft in response to a second electrical adjustment signal supplied to said speed control means;

motor-generator means for providing a source of electrical power for the apparatus;

an electric motor electrically connected to the motor generator means and having an output shaft connected to the input shaft of the first variable transmission;

a manually actuable first conveyor control switch electrically connected between the motor generator and the speed control means of the first variable transmission to provide said first electrical adjustment signal when the first conveyor control switch is closed; and a manually actuable second conveyor control switch electrically connected between the motor-generator and the speed control means of the first variable transmission for providing said second electrical adjustment signal at such times that the second conveyor control switch is closed.

8. The apparatus of claim 7 further comprising means for reversing the direction of rotation of the motor output shaft.

9. The apparatus of claim 7 wherein the first variable transmission is further characterized as having a second output shaft coupled to the first output shaft to be rotated at a rate proportional to the rotation rate of the first output shaft; and wherein the pump drive means comprises:

a second variable transmission of the type having an input shaft, an output shaft, and speed control means for increasing the speed of the first output shaft of the second variable transmission relative to the speed of the input shaft of the second variable transmission in response to a first electrical adjustment signal supplied to the speed control means of the second variable transmission and decreasing the speed of the output shaft of the second variable transmission relative to the speed of the input shaft of the second variable transmission in response to a second electrical adjustment signal supplied to the speed control means of the second variable transmission;

a manually actuable first pump control switch electrically connected between the motor-generator means and the speed control means of the second variable transmission for providing a first electrical adjustment signal to the speed control means of the second variable transmission at such times that the first pump control switch is closed; and a manually actuable second pump control switch electrically connected between the motor-generator means and the speed control means of the second variable transmission to provide a second electrical adjustment signal to the speed control means of the second variable transmission at such times that the second pump control switch is closed.

10. The apparatus of claim 9 further comprising means for providing visual indications of the rates at which asphaltic composition and aggregate are delivered to the pugmill.

11. The apparatus of claim 7 wherein the conveyor drive means further comprises:

high level aggregate detection means mounted on the surge bin and electrically connected to the motor-generator means for providing a high level detection signal at such times that the level of aggregate in the surge bin rises to said selected high level;

low level aggregate detection means mounted on the surge bin and electrically connected to the motor-generator means for providing a low level detection signal at such times that the level of aggregate in the surge bin drops to said selected low level; and first variable transmission control means, electrically connected between the high and low level aggregate detector means and the speed control means of the first variable transmission, for serially providing first and second adjustment signals to the speed control means of the first variable transmission so as to temporarily increase the speed of the first output shaft of the first variable transmission in response to a high level detection signal and for serially providing second and first adjustment signals to the speed control means of the first variable transmission so as to temporarily decrease the speed of the first output shaft of the first variable transmission in response to a low level detection signal.

12. The apparatus of claim 11 wherein the surge bin is characterized as having an open lower end and the conveyor is characterized as being a belt conveyor underlaying the surge bin; wherein an opening is formed in one wall of the surge bin overlaying the conveyor for delivery of aggregate from the surge bin by the conveyor through said opening; wherein a gate is slidably mounted on said one wall of the surge bin for vertical positioning of the gate on said one wall of the surge bin to partially occlude said opening, whereby the rate of delivery of aggregate from the surge bin for a selected rate of operation of the conveyor can be selected by positioning said gate on said one wall of the surge bin; and wherein the low level aggregate detection means comprises:

an aggregate engagement plate pivotally mounted on said gate to swing in a vertical arc against aggregate delivered from the surge bin; and a switch mechanically coupled to the aggregate engagement plate to be actuated in response to downward movement of the aggregate enqagement plate below a pre-selected position of the aggregate engagement plate on said gate.

13. The apparatus of claim 3 wherein the conveyor drive means comprises:

a first variable transmission of the type having an input shaft, a first output shaft, and speed control means for increasing the speed of the first output shaft relative to the speed of the input shaft in response to a first electrical adjustment signal supplied to said speed control means and decreasing the speed of the first output shaft relative to the speed of the input shaft in response to a second electrical adjustment signal supplied to said speed control means;

motor-generator means for providing a source of electrical power for the apparatus;

an electric motor electrically connected to the motor-generator means and having an output shaft connected to the input shaft of the first variable transmission;

high level aggregate detection means mounted on the surge bin and electrically connected to the motor-generator means for providing a high level detection signal at such times that the level of aggregate in the surge bin rises to said selected high level;

low level aggregate detection means mounted on the surge bin and electrically connected to the motor-generator means for providing a low level detection signal at such times that the level of aggregate in the surge bin drops to said selected low level; and first variable transmission control means, electrically connected between the high and low level aggregate detector means and the speed control means of the first variable transmission, for serially providing first and second adjustment signals to the speed control means of the first variable transmission so as to temporarily increase the speed of the first output shaft of the first variable transmission in response to a high level detection signal and for serially providing second and first adjustment signals to the speed control means of the first variable transmission so as to temporarily decrease the speed of the first output shaft of the first variable transmission in response to a low level detection signal.

14. The apparatus of claim 13 wherein the surge bin is characterized as having an open lower end and the conveyor is characterized as being a belt conveyor underlaying the surge bin; wherein an opening is formed in one wall of the surge bin overlaying the conveyor for delivery of aggregate from the surge bin by the conveyor through said opening; wherein a gate is slidably mounted on said one wall of the surge bin for vertical positioning of the gate on said one wall of the surge bin to partially occlude said opening, whereby the rate of delivery of aggregate from the surge bin for a selected rate of operation of the conveyor can be selected by positioning said gate on said one wall of the surge bin; and wherein the low level aggregate detection means comprises:

an aggregate engagement plate pivotally mounted on said gate to swing in a vertical arc against aggregate delivered from the surge bin; and a switch mechanically coupled to the aggregate engagement plate to be actuated in response to downward movement of the aggregate engagement plate below a pre-selected position of the aggregate engagement plate on said gate.

15. The apparatus of claim 13 wherein the first variable transmission is further characterized as having a second output shaft coupled to the first output shaft to be rotated at a rate proportional to the rotation rate of the first output shaft; and wherein the pump drive means comprises:

a second variable transmission of the type having an input shaft, an output shaft, and speed control means for increasing the speed of the first output shaft of the second variable transmission relative to the speed of the input shaft of the second variable transmission in response to a first electrical adjustment signal supplied to the speed control means of the second variable transmission and decreasing the speed of the output shaft of the second variable transmission relative to the speed of the input shaft of the second variable transmission in response to a second electrical adjustment signal supplied to the speed control means of the second variable transmission;

a manually actuable first pump control switch electrically connected between the motor-generator means and the speed control means of the second variable transmission for providing a first electrical adjustment signal to the speed control means of the second variable transmission at such times that the first pump control switch is closed; and a manually actuable second pump control switch electrically connected between the motor-generator means and the speed control means of the second variable transmission to provide a second electrical adjustment signal to the speed control means of the second variable transmission at such times that the second pump control switch is closed.

16. The apparatus of claim 15 further comprising means for providing visual indications of the rates at which asphaltic composition and aggregate are delivered to the pugmill.

17. The apparatus of claim 1 wherein the conveyor drive means comprises:

a first variable transmission of the type having an input shaft, a first output shaft, and speed control means for increasing the speed of the first output shaft relative to the speed of the input shaft in response to a first electrical adjustment signal supplied to said speed control means and decreasing the speed of the first output shaft relative to the speed of the input shaft in response to a second electrical adjustment signal supplied to said speed control means;

motor-generator means for providing a source of electrical power for the apparatus;

an electric motor electrically connected to the motor generator means and having an output shaft connected to the input shaft of the first variable transmission;

a manually actuable first conveyor control switch electrically connected between the motor generator and the speed control means of the first variable transmission to provide said first electrical adjustment signal when the first conveyor control switch is closed; and a manually actuable second conveyor control switch electrically connected between the motor-generator and the speed control means of the first variable transmission for providing said second electrical adjustment signal at such times that the second conveyor control switch is closed.

18. The apparatus of claim 17 further comprising means for reversing the direction of rotation of the motor output shaft.

19. The apparatus of claim 17 wherein the first variable transmission is further characterized as having a second output shaft coupled to the first output shaft to be rotated at a rate proportional to the rotation rate of the first output shaft; and wherein the pump drive means comprises:

a second variable transmission of the type having an input shaft, an output shaft, and speed control means for increasing the speed of the first output shaft of the second variable transmission relative to the speed of the input shaft of the second variable transmission in response to a first electrical adjustment signal supplied to the speed control means of the second variable transmission and decreasing the speed of the output shaft of the second variable transmission relative to the speed of the input shaft of the second variable transmission in response to a second electrical adjustment signal supplied to the speed control means of the second variable transmission;

a manually actuable first pump control switch electrically connected between the motor-generator means and the speed control means of the second variable transmission for providing a first electrical adjustment signal to the speed control means of the second variable transmission at such times that the first pump control switch is closed; and a manually actuable second pump control switch electrically connected between the motor-generator means and the speed control means of the second variable transmission to provide a second electrical adjustment signal to the speed control means of the second variable transmission at such times that the second pump control switch is closed.

20. The apparatus of claim 19 further comprising means for providing visual indications of the rates at which asphaltic composition and aggregate are delivered to the pugmill.

21. The apparatus of claim 17 wherein the conveyor drive means further comprises:

high level aggregate detection means mounted on the surge bin and electrically connected to the motor-generator means for providing a high level detection signal at such times that the level of aggregate in the surge bin rises to said selected high level;

low level aggregate detection means mounted on the surge bin and electrically connected to the motor-generator means for providing a low level detection signal at such times that the level of aggregate in the surge bin drops to said selected low level; and first variable transmission control means, electrically connected between the high and low level aggregate detector means and the speed control means of the first variable transmission, for serially providing first and second adjustment signals to the speed control means of the first variable transmission so as to temporarily increase the speed of the first output shaft of the first variable transmission in response to a high level detection signal and for serially providing second and first adjustment signals to the speed control means of the first variable transmission so as to temporarily decrease the speed of the first output shaft of the first variable transmission in response to a low level detection signal.

22. The apparatus of claim 21 wherein the surge bin is characterized as having an open lower end and the conveyor is characterized as being a belt conveyor underlaying the surge bin; wherein an opening is formed in one wall of the surge bin overlaying the conveyor for delivery of aggregate from the surge bin by the conveyor through said opening; wherein a gate is slidably mounted on said one wall of the surge bin for vertical positioning of the gate on said one wall of the surge bin to partially occlude said opening, whereby the rate of delivery of aggregate from the surge bin for a selected rate of operation of the conveyor can be selected by positioning said gate on said one wall of the surge bin; and wherein the low level aggregate detection means comprises:

an aggregate engagement plate pivotally mounted on said gate to swing in a vertical arc against aggregate delivered from the surge bin; and a switch mechanically coupled to the aggregate engagement plate to be actuated in response to downward movement of the aggregate engagement plate below a pre-selected position of the aggregate engagement plate on said gate.

23. The apparatus of claim 1 wherein the conveyor drive means comprises:

a first variable transmission of the type having an input shaft, a first output shaft, and speed control means for increasing the speed of the first output shaft relative to the speed of the input shaft in response to a first electrical adjustment signal supplied to said speed control means and decreasing the speed of the first output shaft relative to the speed of the input shaft in response to a second electrical adjustment signal supplied to said speed control means;

motor-generator means for providing a source of electrical power for the apparatus;

an electric motor electrically connected to the motor-generator means and having an output shaft connected to the input shaft of the first variable transmission;

high level aggregate detection means mounted on the surge bin and electrically connected to the motor-generator means for providing a high level detection signal at such times that the level of aggregate in the surge bin rises to said selected high level;

low level aggregate detection means mounted on the surge bin and electrically connected to the motor-generator means for providing a low level detection signal at such times that the level of aggregate in the surge bin drops to said selected low level; and first variable transmission control means, electrically connected between the high and low level aggregate detector means and the speed control means of the first variable transmission, for serially providing first and second adjustment signals to the speed control means of the first variable transmission so as to temporarily increase the speed of the first output shaft of the first variable transmission in response to a high level detection signal and for serially providing second and first adjustment signals to the speed control means of the first variable transmission so as to temporarily decrease the speed of the first output shaft of the first variable transmission in response to a low level detection signal.

24. The apparatus of claim 23 wherein the surge bin is characterized as having an open lower end and the conveyor is characterized as being a belt conveyor underlaying the surge bin; wherein an opening is formed in one wall of the surge bin overlaying the conveyor for delivery of aggregate from the surge bin by the conveyor through said opening; wherein a gate is slidably mounted on said one wall of the surge bin for vertical positioning of the gate on said one wall of the surge bin to partially occlude said opening, whereby the rate of delivery of aggregate from the surge bin for a selected rate of operation of the conveyor can be selected by positioning said gate on said one wall of the surge bin; and wherein the low level aggregate detection means comprises:

an aggregate engagement plate pivotally mounted on said gate to swing in a vertical arc against aggregate delivered from the surge bin; and a switch mechanically coupled to the aggregate engagement plate to be actuated in response to downward movement of the aggregate engagement plate below a preselected position of the aggregate engagement plate on said gate.

25. The apparatus of claim 23 wherein the first variable transmission is further characterized as having a second output shaft coupled to the first output shaft to be rotated at a rate proportional to the rotation rate of the first output shaft; and wherein the pump drive means comprises:

a second variable transmission of the type having an input shaft, an output shaft, and speed control means for increasing the speed of the first output shaft of the second variable transmission relative to the speed of the input shaft of the second variable transmission in response to a first electrical adjustment signal supplied to the speed control means of the second variable transmission and decreasing the speed of the output shaft of the second variable transmission relative to the speed of the input shaft of the second variable transmission in response to a second electrical adjustment signal supplied to the speed control means of the second variable transmission;

a manually actuable first pump control switch electrically connected between the motor-generator means and the speed control means of the second variable transmission for providing a first electrical adjustment signal to the speed control means of the second variable transmission at such times that the first pump control switch is closed; and a manually actuable second pump control switch electrically connected between the motor-generator means and the speed control means of the second variable transmission to provide a second electrical adjustment signal to the speed control means of the second variable transmission at such times that the second pump control switch is closed.

26. The apparatus of claim 25 further comprising means for providing visual indications of the rates at which asphaltic composition and aggregate are delivered to the pugmill.

27. A method for producing cold mix asphalt from a non-constant aggregate feed, comprising the steps of:

receiving the aggregate in a surge bin; conveying the aggregate from the surge bin to a pugmill at a non-constant rate to maintain the level of aggregate in the surge bin between selected high and low levels;

injecting liquid asphaltic composition into the pugmill at a rate that varies with the rate at which aggregate is conveyed from the surge bin to maintain a fixed ratio of aggregate to asphaltic composition in the pugmill;

mixing the aggregate and asphaltic composition into cold mix asphalt in the pugmill; and discharging the cold mix asphalt from the pugmill.

28. The method of claim 27 further comprising the steps of:

moving the surge bin and pugmill along a roadway during roadway planing operations; and delivering material planed from the roadway to the surge bin to provide said aggregate feed.

29. The method of claim 28 wherein the step of moving the surge bin and pug mill along a roadway is further characterized as towing the surge bin and pugmill behind a roadway planing machine.

30. The method of claim 29 wherein the step of delivering material planed from the roadway to the surge bin comprises the steps of:

depositing the material planed from the roadway on an inclined screen above the surge bin to sort the material into two portions, a first portion, having a particle size smaller than a pre-selected maximum particle size, passing through the screen into the surge bin and a second portion, comprising pieces of material larger than said pre-selected maximum particle size, gravitating off the lower end of the screen;

receiving the second portion of the material in a crusher wherein said portion is comminuted to reduce the particle size thereof; and returning the comminuted material to said screen.

31. The method of claim 28 wherein the step of delivering material planed from the roadway to the surge bin comprises the steps of:

depositing the material planed from the roadway on an inclined screen above the surge bin to sort the material into two portions, a first portion, having a particle size smaller than a pre-selected maximum particle size, passing through the screen into the surge bin and a second portion, comprising pieces of material larger than said pre-selected maximum particle size, gravitating off the lower end of the screen;

receiving the second portion of the material in a crusher wherein said portion is comminuted to reduce the particle size thereof; and returning the comminuted material to said screen.

32. The method of claim 31 wherein the step of conveying the aggregate from the surge bin to a pugmill at a non-constant rate to maintain the level of aggregate in the surge bin between selected high and low levels is comprised of the steps:

conveying the aggregate from the surge bin to the pugmill at a preset normal conveyance rate at such times that the level of aggregate in the surge bin is between said selected high and low levels;

temporarily conveying the aggregate from the surge bin to the pugmill at a pre-selected maximum conveyance rate, greater than the normal conveyance rate, in response to the attainment of the level of aggregate in the surge bin of said selected high level; and temporarily conveying the aggregate from the surge bin to the pugmill at a pre-selected minimum conveyance rate, smaller than the normal conveyance rate, in response to a drop in the level of the aggregate in the surge bin to said selected low level.

33. The method of claim 28 wherein the step of conveying the aggregate from the surge bin to a pugmill at a non-constant rate to maintain the level of aggregate in the surge bin between selected high and low levels is comprised of the steps:

conveying the aggregate from the surge bin to the pugmill at a preset normal conveyance rate at such times that the level of aggregate in the surge bin is between said selected high and low levels;

temporarily conveying the aggregate from the surge bin to the pugmill at a pre-selected maximum conveyance rate, greater than the normal conveyance rate, in response to the attainment of the level of aggregate in the surge bin of said selected high level; and temporarily conveying the aggregate from the surge bin to the pugmill at a pre-selected minimum conveyance rate, smaller than the normal conveyance rate, in response to a drop in the level of the aggregate in the surge bin to said selected low level.

34. The method of claim 27 wherein the step of conveying the aggregate from the surge bin to a pugmill at a non-constant rate to maintain the level of aggregate in the surge bin between selected high and low levels is comprised of the steps:

conveying the aggregate from the surge bin to the pugmill at a preset normal conveyance rate at such times that the level of aggregate in the surge bin is between said selected high and low levels;

temporarily conveying the aggregate from the surge bin to the pugmill at a pre-selected maximum conveyance rate, greater than the normal conveyance rate, in response to the attainment of the level of aggregate in the surge bin of said selected high level; and temporarily conveying the aggregate from the surge bin to the pugmill at a pre-selected minimum conveyance rate, smaller than the normal conveyance rate, in response to a drop in the level of the aggregate in the surge bin to said selected low level.

* * * * *